US009501023B2

(12) United States Patent
Takamizawa et al.

(10) Patent No.: US 9,501,023 B2
(45) Date of Patent: Nov. 22, 2016

(54) IMAGE PROCESSING APPARATUS, IMAGE PROCESSING METHOD, AND IMAGE PROCESSING SYSTEM

(71) Applicants: Takuma Takamizawa, Kanagawa (JP); Hiroaki Suzuki, Chiba (JP)

(72) Inventors: Takuma Takamizawa, Kanagawa (JP); Hiroaki Suzuki, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/855,847

(22) Filed: Sep. 16, 2015

(65) Prior Publication Data

US 2016/0077482 A1 Mar. 17, 2016

(30) Foreign Application Priority Data

Sep. 16, 2014 (JP) ..... 2014-188267
Sep. 2, 2015 (JP) ..... 2015-173206

(51) Int. Cl.
*G03G 15/20* (2006.01)
*G03G 15/34* (2006.01)
*G03G 15/00* (2006.01)

(52) U.S. Cl.
CPC .. *G03G 15/6585* (2013.01); *G03G 2215/0081* (2013.01); *G03G 2215/00805* (2013.01)

(58) Field of Classification Search
CPC ..... G03G 15/04027; G03G 15/04018; G03G 15/36
See application file for complete search history.

(56) References Cited

U.S. PATENT DOCUMENTS 7,511,854 B2 3/2009 Yoshikawa et al.
7,697,853 B2 * 4/2010 Ahn ..... H04N 1/6022 399/27
8,107,844 B2 * 1/2012 Harigae ..... G03G 15/5016 399/81
8,412,066 B2 * 4/2013 Moroney ..... G03G 15/5016 399/15
9,041,971 B2 5/2015 Fukamachi
2003/0053117 A1 * 3/2003 Payne ..... G03G 15/0126 358/1.15
2012/0062956 A1 3/2012 Kitagawa et al.
2012/0063802 A1 3/2012 Suzuki et al.
2012/0237247 A1 9/2012 Tokushima et al.
2013/0278943 A1 10/2013 Kurosawa et al.
2015/0062601 A1 3/2015 Tokushima et al.

FOREIGN PATENT DOCUMENTS

JP 4380344 10/2009
JP 2012-083736 4/2012
JP 2013-003315 1/2013

* cited by examiner

*Primary Examiner* — Minh Phan
*Assistant Examiner* — Leon W Rhodes, Jr.
(74) *Attorney, Agent, or Firm* — Oblon, McClelland, Maier & Neustadt, L.L.P.

(57) ABSTRACT

A storage unit stores a surface effect selection table in which density values, types of the surface effects, and types of linkage effects as other surface effects related to the types of the surface effects are associated. A reading unit reads the types of the surface effects and the types of the linkage effects corresponding to the density values specified in the first gloss control plane data from the surface effect selection table when type information indicatse test printing. A first generating unit generates second gloss control plane data specifying the types of the surface effects and the gloss regions specified in the first gloss control plane data, and the read types of the linkage effects corresponding to the types of the surface effects and linkage regions. A second generating unit generates special color colorant plane data used by an execution unit from the second gloss control plane data.

20 Claims, 23 Drawing Sheets

| SURFACE EFFECT TYPE | GLOSS | DEVIATION |
|---|---|---|
| PREMIUM GLOSS (PG) | Gs≥80 | ΔGs≤10 |
| GLOSS (G) | Gs=Gs(GLOSS) | ΔGs≤10 |
| MATT (M) | Gs=Gs(1C30% HALFTONE DOT) | ΔGs≤10 |
| PREMIUM MATT (PM) | Gs≤10 | ΔGs≤10 |

FIG.5

| SURFACE EFFECT TYPE | DENSITY VALUE (%) |
|---|---|
| PG | 98% |
| G | 90% |
| M | 16% |
| PM | 6% |

FIG.6

| DRAWING OBJECT | COORDINATES | DENSITY VALUE |
|---|---|---|
| A, B, C | (x1, y1)-(x2, y2) | 98% |
| (SQUARE) | (x3, y3)-(x4, y4) | 90% |
| ... | ... | ... |

FIG.11

| DENSITY (%) | DENSITY | | | SURFACE EFFECT | GLOSSER | SPECIFICATION CONTENT | | LINKAGE EFFECT 1 | LINKAGE EFFECT 2 | LINKAGE EFFECT 3 |
|---|---|---|---|---|---|---|---|---|---|---|
| | REPRESENTATIVE VALUE | VALUE RANGE | | | ON/OFF | CLEAR TONER PLANE 1 | CLEAR TONER PLANE 2 | | | |
| 98% | 250 | 248 | 255 | PREMIUM GLOSS TYPE A | ON | INVERSE MASK A | NO DATA | PREMIUM GLOSS TYPE B | PREMIUM GLOSS TYPE C | |
| 96% | 245 | 243 | 247 | PREMIUM GLOSS TYPE B | ON | INVERSE MASK B | NO DATA | PREMIUM GLOSS TYPE A | PREMIUM GLOSS TYPE C | |
| 94% | 240 | 238 | 242 | PREMIUM GLOSS TYPE C | ON | INVERSE MASK C | NO DATA | PREMIUM GLOSS TYPE A | PREMIUM GLOSS TYPE B | |
| 92% | 235 | 233 | 237 | RESERVED | | | | RESERVED | RESERVED | |
| 90% | 230 | 228 | 232 | GLOSS TYPE 1 | OFF | INVERSE MASK 1 | NO DATA | GLOSS TYPE 2 | GLOSS TYPE 3 | GLOSS TYPE 4 |
| 88% | 224 | 222 | 227 | GLOSS TYPE 2 | OFF | INVERSE MASK 2 | NO DATA | GLOSS TYPE 1 | GLOSS TYPE 3 | GLOSS TYPE 4 |
| 86% | 219 | 217 | 221 | GLOSS TYPE 3 | OFF | INVERSE MASK 3 | NO DATA | GLOSS TYPE 2 | GLOSS TYPE 2 | GLOSS TYPE 2 |
| 84% | 214 | 212 | 216 | GLOSS TYPE 4 | OFF | INVERSE MASK 4 | NO DATA | GLOSS TYPE 2 | GLOSS TYPE 2 | GLOSS TYPE 2 |
| 82% | 209 | 207 | 211 | RESERVED | | | | RESERVED | RESERVED | |
| 46% | 117 | 115 | 119 | RESERVED | | | | RESERVED | RESERVED | |
| 44% | 112 | 110 | 114 | WATERMARK CHARACTER 3 (XXX) | OFF | NO DATA | TILE CHARACTER STRING 3 | WATERMARK CHARACTER 1 (SAMPLE) | WATERMARK CHARACTER 2 (REPLICATION PROHIBITED) | |
| 42% | 107 | 105 | 109 | WATERMARK CHARACTER 2 (REPLICATION PROHIBITED) | | NO DATA | TILE CHARACTER STRING 2 | WATERMARK CHARACTER 1 (SAMPLE) | WATERMARK CHARACTER 3 (XXX) | |
| 40% | 102 | 100 | 104 | WATERMARK CHARACTER 1 (SAMPLE) | | NO DATA | TILE CHARACTER STRING 1 | WATERMARK CHARACTER 2 (REPLICATION PROHIBITED) | WATERMARK CHARACTER 3 (XXX) | |
| 38% | 97 | 95 | 99 | RESERVED | | | | RESERVED | RESERVED | |
| 36% | 92 | 90 | 94 | RESERVED | | | | RESERVED | RESERVED | |
| 34% | 87 | 85 | 89 | GROUND PATTERN 3 (XXX) | | NO DATA | TILE GROUND PATTERN 3 | GROUND PATTERN 1 (WAVE) | GROUND PATTERN 2 (LATTICE) | |
| 32% | 82 | 80 | 84 | GROUND PATTERN 2 (LATTICE) | | NO DATA | TILE GROUND PATTERN 2 | GROUND PATTERN 1 (WAVE) | GROUND PATTERN 3 (XXX) | |
| 30% | 76 | 74 | 78 | GROUND PATTERN 1 (WAVE) | | NO DATA | TILE GROUND PATTERN 1 | GROUND PATTERN 2 (LATTICE) | GROUND PATTERN 3 (XXX) | |
| 28% | 71 | 69 | 73 | RESERVED | | | | RESERVED | RESERVED | |
| 26% | 66 | 64 | 68 | RESERVED | | | | RESERVED | RESERVED | |
| 24% | 61 | 59 | 63 | TACTILE PATTERN TYPE 3 (ROUGH) | | NO DATA | TILE MESH DESIGNED PATTERN 3 | TACTILE PATTERN TYPE 1 (FINE) | TACTILE PATTERN TYPE 2 (MIDDLE) | |
| 22% | 56 | 54 | 58 | TACTILE PATTERN TYPE 2 (MIDDLE) | | NO DATA | TILE MESH DESIGNED PATTERN 2 | TACTILE PATTERN TYPE 1 (FINE) | TACTILE PATTERN TYPE 3 (ROUGH) | |
| 20% | 51 | 49 | 53 | TACTILE PATTERN TYPE 1 (FINE) | | NO DATA | TILE MESH DESIGNED PATTERN 1 | TACTILE PATTERN TYPE 2 (MIDDLE) | TACTILE PATTERN TYPE 3 (ROUGH) | |
| 18% | 46 | 44 | 48 | RESERVED | | | | RESERVED | RESERVED | |
| 16% | 41 | 39 | 43 | MATT TYPE 4 | OFF | HALFTONE 4 | NO DATA | MATT TYPE 1 | MATT TYPE 2 | MATT TYPE 3 |
| 14% | 36 | 34 | 38 | MATT TYPE 3 | OFF | HALFTONE 3 | NO DATA | MATT TYPE 1 | MATT TYPE 2 | MATT TYPE 4 |
| 12% | 31 | 29 | 33 | MATT TYPE 2 | OFF | HALFTONE 2 | NO DATA | MATT TYPE 1 | MATT TYPE 3 | MATT TYPE 4 |
| 10% | 25 | 23 | 28 | MATT TYPE 1 | OFF | HALFTONE 1 | NO DATA | MATT TYPE 2 | MATT TYPE 3 | MATT TYPE 4 |
| 8% | 20 | 18 | 22 | RESERVED | | | | RESERVED | RESERVED | |
| 6% | 15 | 13 | 17 | PREMIUM MATT TYPE C | ON&OFF | NO DATA | SOLID | PREMIUM MATT TYPE A | PREMIUM MATT TYPE B | |
| 4% | 10 | 8 | 12 | PREMIUM MATT TYPE B | ON&OFF | NO DATA | SOLID | PREMIUM MATT TYPE A | PREMIUM MATT TYPE C | |
| 2% | 5 | 1 | 7 | PREMIUM MATT TYPE A | ON&OFF | NO DATA | SOLID | PREMIUM MATT TYPE B | PREMIUM MATT TYPE C | |
| 0% | 0 | 0 | 0 | NONE | OFF | NO DATA | NO DATA | NONE | NONE | |

FIG.12

| SURFACE EFFECT TYPE | ANALYSIS INFORMATION | |
|---|---|---|
| | NUMBER OF TIMES OF USAGE | AVERAGE AREA |
| PREMIUM GLOSS TYPE A | 5 | 100 |
| PREMIUM GLOSS TYPE B | 4 | 120 |
| PREMIUM GLOSS TYPE C | 4 | 90 |
| GLOSS TYPE 1 | 2 | 50 |
| GLOSS TYPE 2 | 3 | 60 |
| GLOSS TYPE 3 | 3 | 45 |
| GLOSS TYPE 4 | 2 | 45 |
| WATERMARK CHARACTER 3 (XXX) | 1 | 20 |
| WATERMARK CHARACTER 2 (REPLICATION PROHIBITED) | 0 | 0 |
| WATERMARK CHARACTER 1 (SAMPLE) | 1 | 20 |
| GROUND PATTERN 3 (XXX) | 1 | 300 |
| GROUND PATTERN 2 (LATTICE) | 1 | 270 |
| GROUND PATTERN 1 (WAVE) | 1 | 320 |
| TACTILE PATTERN TYPE 3 (ROUGH) | 2 | 300 |
| TACTILE PATTERN TYPE 2 (MIDDLE) | 1 | 240 |
| TACTILE PATTERN TYPE 1 (FINE) | 2 | 330 |
| MATT TYPE 4 | 2 | 80 |
| MATT TYPE 3 | 3 | 90 |
| MATT TYPE 2 | 4 | 70 |
| MATT TYPE 1 | 3 | 85 |
| PREMIUM MATT TYPE C | 5 | 100 |
| PREMIUM MATT TYPE B | 6 | 80 |
| PREMIUM MATT TYPE A | 5 | 90 |

FIG.14

| IDENTIFICATION INFORMATION | SETTING INFORMATION | | | | | |
|---|---|---|---|---|---|---|
| | THIRD SETTING (SPECIFICATION OF NUMBER OF RECORDING MEDIA) | SIXTH SETTING | FOURTH SETTING (ARRANGEMENT CHANGE) | FIFTH SETTING (AGGREGATION) | FIRST SETTING (EXTRACTION OF OVERLAPPED REGION) | SECOND SETTING (PRINTING SPEED) |
| 1 | OFF | OFF | OFF | OFF | OFF | OFF |
| 2 | OFF | OFF | OFF | OFF | ON | OFF |
| 3 | OFF | OFF | OFF | OFF | OFF | ON |
| 4-1 | ON | OFF * | ON | OFF * | OFF | OFF |
| 4-2 | ON | OFF * | OFF * | ON | OFF | OFF |
| 4-3 | ON | ON | - | - | OFF | OFF |

IMAGE PROCESSING APPARATUS, IMAGE PROCESSING METHOD, AND IMAGE PROCESSING SYSTEM

CROSS-REFERENCE TO RELATED APPLICATIONS

The present application claims priority to and incorporates by reference the entire contents of Japanese Patent Application No. 2014-188267 filed in Japan on Sep. 16, 2014 and Japanese Patent Application No. 2015-173206 filed in Japan on Sep. 2, 2015.

BACKGROUND OF THE INVENTION

1. Field of the Invention

The present invention relates to an image processing apparatus, an image processing method, and an image processing system.

2. Description of the Related Art

Apparatuses have been known that form an image using color toners of CMYK or the like and special color toner other than the color toners. Furthermore, a technique of providing surface effects such as gloss onto a recording medium using the special color toner has been known (for example, see Japanese Laid-open Patent Publication No. 2012-083736).

Japanese Laid-open Patent Publication No. 2012-083736 discloses generation of special color colorant plane data to be used in a printing apparatus using gloss control plane data that specifies types of the surface effects and gloss regions to which the surface effects are applied that are included in print data.

Conventionally, surface effects other than the surface effects of types specified in the print data cannot be checked easily.

SUMMARY OF THE INVENTION

It is an object of the present invention to at least partially solve the problems in the conventional technology.

According to an embodiment, an image processing apparatus includes a storage unit, an acquisition unit, a determination unit, a reading unit, a first generating unit, and a second generating unit. The storage unit stores therein a surface effect selection table in which density values indicating surface effects as visual or tactile effects on a recording medium, types of the surface effects, and types of linkage effects as other surface effects related to the types of the surface effects are associated with one another. The acquisition unit acquires print data that includes type information indicating normal printing or test printing, first gloss control plane data specifying density values for specifying the types of the surface effects and gloss regions to which the surface effects are applied, and first color plane data of a color image. The determination unit determines whether the type information indicates the normal printing or the test printing. The reading unit reads the types of the surface effects and the types of the linkage effects that correspond to the density values specified in the first gloss control plane data from the surface effect selection table when the type information has been determined to indicate the test printing. The first generating unit generates second gloss control plane data that specifies the types of the surface effects and the gloss regions that are specified in the first gloss control plane data, and the types of the linkage effects corresponding to the types of the surface effects and having been read and linkage regions to which the linkage effects are applied. The second generating unit generates special color colorant plane data that is used by an execution unit configured to apply a special color colorant onto the recording medium from the second gloss control plane data.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a view illustrating an example of a density value selection table;

FIG. 6 is a table illustrating a correspondence relation among drawing objects, coordinates, and density values;

FIG. 11 is a view illustrating an example of a surface effect selection table;

FIG. 12 is a view illustrating an example of a data format of history information;

FIG. 14 is a view illustrating an example of a print setting table;

DETAILED DESCRIPTION OF THE PREFERRED EMBODIMENTS

Hereinafter, embodiments of an image processing apparatus, an image processing method, and an image processing system will be described in detail with reference to the accompanying drawings.

First Embodiment

First, the configuration of an image processing system according to a first embodiment will be described.

Figure 1:
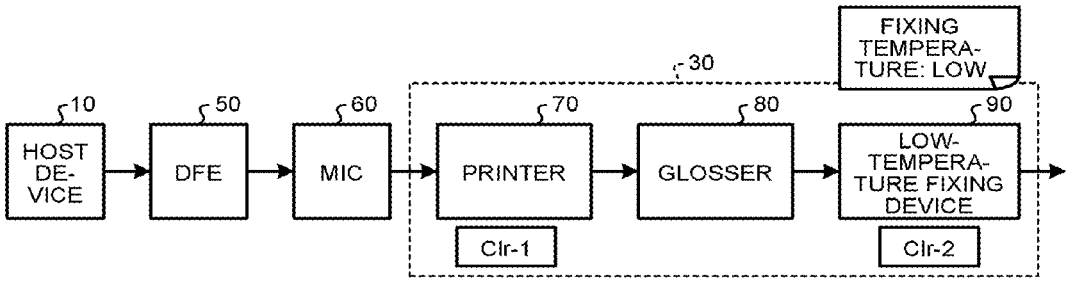
FIG. 1 is a diagram illustrating the configuration of an image processing system.

FIG. 1 is a diagram illustrating an example of the configuration of the image processing system in the embodiment. In the embodiment, the image processing system is configured by connecting an image processing apparatus (digital front end (DFE)) 50 (hereinafter, referred to as "DFE 50", which corresponds to an image processing apparatus), an interface controller (mechanism interface (I/F) controller (MIC)) 60 (hereinafter, referred to as "MIC 60"), a printer 70, and a glosser 80 and a low-temperature fixing device 90 as post-processing devices.

The DFE 50 communicates with the printer 70 through the MIC 60 and controls image formation in the printer 70.

A host device 10 such as a personal computer (PC) is connected to the DFE 50. The DFE 50 receives print data from the host device 10, generates output data, and transmits it to the printer 70 through the MIC 60.

At least CMYK color toners and special color toner are mounted on the printer 70. An image formation unit including a photoconductor, a charging device, a developing device, and a photoconductor cleaner, an exposing device, and a fixing device are mounted on the printer 70 for each toner.

Although the printer 70 is a device forming an image using the toner in the embodiment, the printer 70 may be a device forming an image using ink containing a colorant, and the colorant that is used for image formation is not limited to the toner. When the image is formed using ink, an ink jet printer needs to be employed as the printing apparatus 30.

The printer 70 forms a toner image with the CMYK color toners and the special color toner on a recording medium based on the received output data. Although details will be described later, the output data includes special color colorant plane data that is used in the printer 70 for applying the special color toner and pieces of colored colorant plane data for applying the color toners. The printer 70 applies the special color toner onto the recording medium based on the special color colorant plane data and applies the color toners onto the recording medium based on the pieces of colored colorant plane data so as to form the toner image.

In the embodiment, the printing apparatus 30 forms an image using the toner as an example.

In the embodiment, the printer 70, the glosser 80, and the low-temperature fixing device 90 configure the printing apparatus 30. It should be noted that the printing apparatus 30 corresponds to an execution unit executing image formation. The execution unit applies at least one of the special color toner and the color toners onto the recording medium so as to execute image formation. In the embodiment, description is made while the printing apparatus 30 corresponds to the execution unit.

The special color toner is toner that is used for applying a surface effect onto the recording medium or forming a gloss region on the recording medium. The special color toner is toner of a color other than the CMYK color toners. Examples of the special color toner include transparent (colorless) toner, white toner, gold toner, and silver toner. The transparent (colorless) toner indicates toner having transmittance of equal to or higher than 70%, for example. In the embodiment, the transparent toner is used as the special color toner, as an example. Alternatively, the white toner or the like may be used as the special color toner.

The printer 70 emits light beams from the exposing devices so as to form toner images with the respective toners on the photoconductors based on the output data transmitted from the DFE 50 through the MIC 60. Then, the toner images are transferred onto the recording medium and are fixed by heating and pressure at a temperature (normal temperature) within a predetermined range by the fixing device. With this processing, an image is formed on the recording medium. The configuration of the printer 70 is one that uses a well-known electrophotography system, for example. The recording medium only needs to be a medium on which an image can be formed. The recording medium is a well-known paper medium (paper), synthetic paper, and plastic paper, for example.

The glosser 80 is controlled to be turned On or Off by On/Off information specified by the DFE 50. The glosser 80 presses the image formed on the recording medium by the printer 70 at a high temperature and a high pressure when it is turned On, and then, cools to separate the recording medium on which the image has been formed from a main body. This processing uniformly compresses total adhesion amounts of the toners on respective pixels to which the toners of equal to or larger than a predetermined amount have adhered on the entire image formed on the recording medium.

An image formation unit including a photoconductor, a charging device, a developing device, and a photoconductor cleaner for the special color toner, an exposing device, and a fixing device for fixing the special color toner are mounted on the low-temperature fixing device 90. The special color colorant plane data, which will be described later, generated by the DFE 50 in order to use the low-temperature fixing device 90 is input to the low-temperature fixing device 90. When the DFE 50 has generated the special color colorant plane data that is used in the low-temperature fixing device 90, the low-temperature fixing device 90 forms a toner image with the special color toner using the special color colorant plane data, superimposes the toner image on the recording medium pressed by the glosser 80, and fixes the toner image onto the recording medium by heating or pressing at a temperature or pressure lower than a normal temperature or pressure by the fixing device.

The print data that is output to the DFE 50 from the host device 10 is described herein.

The host device 10 generates the print data by a previously installed image processing application and transmits the print data to the DFE 50. The image processing application can handle image data of a special color plane for pieces of image data of respective color planes such as RGB planes and CMYK planes in which density values of respective colors are specified for respective pixels. The special color plane is image data for causing special color toner or ink of white, gold, or silver to adhere in addition to basic colors of CMYK or RGB and is data for a printer on which the special color toner or ink is mounted. As the special color plane, R is added to the basic colors of CMYK or Y is added to the basic colors of RGB in some cases in order to improve color reproducibility. Normally, the clear toner is used as one of special colors.

In the embodiment, the special color toner is used for providing surface effects as visual or tactile effects that are applied to the recording medium.

The image processing application of the host device 10 generates gloss control plane data as image data of the special color plane in addition to pieces of color plane data in accordance with designation by the user for the input image data.

The pieces of color plane data are pieces of data specifying the color image. To be specific, the pieces of color plane data are pieces of image data specifying the density values of colors of RGB or CMYK for the respective pixels. In the pieces of color plane data, for example, one pixel is expressed by 8 bits. With this expression, the pieces of color plane data specify colors and densities designated by the user for the respective pixels. Hereinafter, the pieces of color plane data included in the print data that the DFE 50 receives from the host device 10 are referred to as pieces of first color plane data for description.

Figure 2:
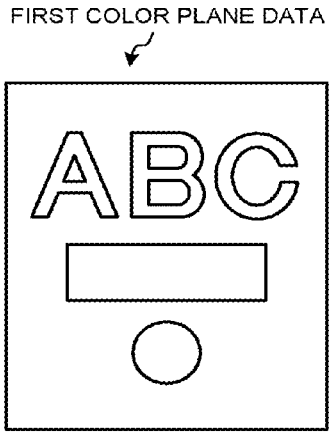
FIG. 2 is a descriptive view for explaining an example of first color plane data.

FIG. 2 is a descriptive view for explaining an example of the first color plane data. In FIG. 2, density values corresponding to colors that the user has specified with the image processing application are given to respective drawing objects of "A", "B", and "C", for example.

The gloss control plane data is data that specifies density values for specifying types of the surface effects as visual or tactile effects on the recording medium and gloss regions to which the surface effects are applied (hereinafter, referred to as gloss regions) on the recording medium. In other words, the gloss control plane data is data that specifies the density values indicating the types of the surface effects for the respective pixels. Furthermore, the gloss control plane data specifies the gloss regions to which the surface effects are applied with groups of pixels (pixel groups) with the specified density values. The gloss control plane data therefore specifies the types of the surface effects and the gloss regions by specifying the density values for the respective pixels.

Hereinafter, the gloss control plane data included in the print data that the DFE 50 receives from the host device 10 is referred to as first gloss control plane data for description.

The first gloss control plane data is expressed by density values of 8 bits in a range of "0" to "255" for the respective pixels, for example, and the types of the surface effects are associated with the density values (note that the density values may be expressed by 16 bits, 32 bits, or 0 to 100%). The same value is set to regions to which the same surface effect is desired to be applied regardless of densities of the special color toner that is made to adhere actually. Regions can therefore be easily identified from the first gloss control plane data without data indicating the regions if necessary. That is to say, the first gloss control plane data indicates the types of the surface effects and the gloss regions to which the surface effects are applied. It should be noted that data indicating the gloss regions to which the surface effects are applied may be added to the first gloss control plane data separately.

The host device 10 sets the types of the surface effects for the drawing objects that the user has specified with the image processing application as the density values for the respective drawing objects so as to generate the first gloss control plane data in a vector format.

The respective pixels forming the first gloss control plane data correspond to pixels of the pieces of first color plane data. The pieces of first color plane data and the first gloss control plane data are configured based on a page unit.

Figures 3, 4:
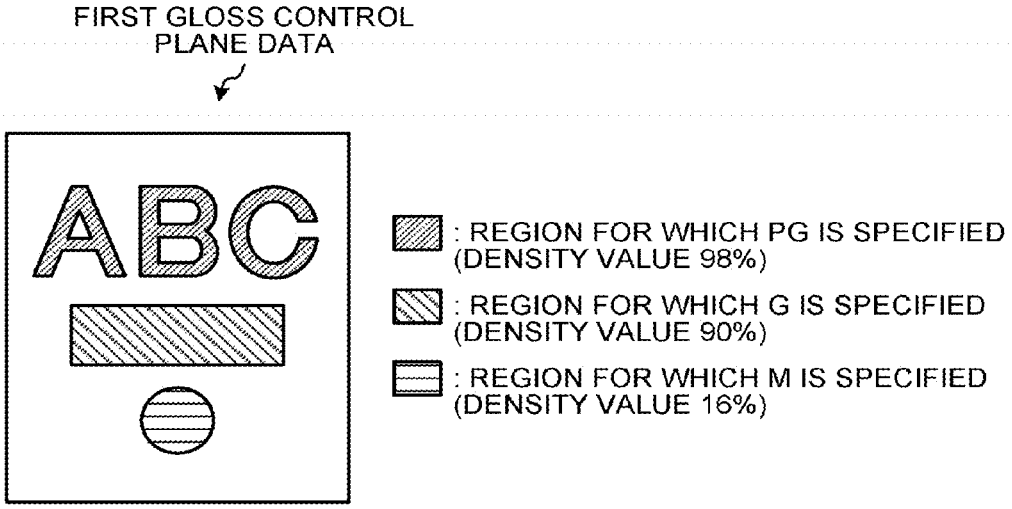
FIG. 3 is a table illustrating an example of types of the surface effects.
FIG. 4 is a descriptive view for explaining an example of first gloss control plane data.

FIG. 3 is a table illustrating an example of the types of the surface effects. The types of the surface effects include those related to presence or absence of gloss, surface protection, watermark with information embedded, texture, and the like in a roughly classified manner. There are roughly classified four types of the surface effects related to the presence or absence of gloss, that is, premium gloss (PG), gloss (G), matt (M) and premium matt (PM) in the order from the highest degree of gloss (glossiness) as illustrated in FIG. 3. Hereinafter, the premium gloss is referred to as "PG", the gloss is referred to as "G", the matt is referred to as "M", and the premium matt is referred to as "PM" in some cases.

The premium gloss and the gloss provide high glossiness whereas the matt and the premium matt reduce glossiness inversely. In particular, the premium matt provides glossiness lower than the glossiness of a normal recording medium. FIG. 3 indicates that the glossiness Gs of the premium gloss is equal to or higher than 80, the gloss has solid glossiness that is made by primary colors or secondary colors, the matt has glossiness that is made by primary colors with halftone dots of 30%, and the glossiness of the premium matt is equal to or lower than 10.

Deviation of the glossiness is expressed by $\Delta Gs$ and is set to equal to or lower than 10. Among these types of the surface effects, higher density values are associated with surface effects providing higher glossiness, and lower density values are associated with surface effects reducing glossiness. Intermediate density values are associated with surface effects such as watermark and texture. For example, characters, ground patterns, or the like are used as the watermark. The texture expresses characters or designed patterns and can provide a visual effect and a tactile effect. For example, a stained-glass pattern can be provided with clear toner. The surface protection is provided by employing the premium gloss or the gloss alternatively.

The user specifies regions of an image expressed by the image data as a processing target to which the surface effects are applied and types of the surface effects that are applied to the regions through the image processing application. The host device 10 executing the image processing application generates the first gloss control plane data specifying the gloss regions to which the surface effects are applied and the types of the surface effects by setting the density values corresponding to the surface effects designated by the user to the drawing objects configuring the regions designated by the user. Correspondence relations between the density values and the types of the surface effects will be described later.

FIG. 4 is a descriptive view for explaining an example of the first gloss control plane data. In the example of the first gloss control plane data in FIG. 4, the user applies the surface effect "PG" to a drawing object "ABC", applies the surface effect "G" to a drawing object "(oblong shape)", and applies the surface effect "M" to a drawing object "(circular shape)". It should be noted that the density values set to the respective surface effects are specified in association with the types of the surface effects in a density value selection table (see FIG. 5), which will be described later.

Thus, the first gloss control plane data is generated by a plane different from the pieces of first color plane data with the image processing application of the host device 10. A portable document format (PDF) is used as each data format of the pieces of first color plane data and the first gloss control plane data, for example. Print data in which pieces of PDF image data of the respective planes are integrated is generated. The data format of each of the pieces of image data of the respective planes is not limited to PDF and an arbitrary format can be used therefor.

The image processing application of the host device 10 converts the types of the surface effects designated by the user into density values so as to generate the first gloss control plane data. The conversion is performed with reference to the density value selection table previously stored in a storage unit of the host device 10.

The density value selection table is table data in which the types of the surface effects and the density values of the first gloss control plane data that correspond to the types of the surface effects are associated with each other.

FIG. 5 is a view illustrating an example of the density value selection table. The example of FIG. 5 indicates that a density value corresponding to a region for which the user has specified the premium gloss "PG" is a pixel value corresponding to "98%", a density value corresponding to a region for which the user has specified the gloss "G" is a pixel value corresponding to "90%", a density value corresponding to a region for which the user has specified the matt "M" is a pixel value corresponding to "16%", and a density value corresponding to a region for which the user has specified the premium matt "PM" is a pixel value corresponding to "6%".

The correspondence between the types of the surface effects and the density values that is stored in the density value selection table is the same as the correspondence between the types of the surface effects and the density values that is described in a surface effect selection table (details thereof will be described later) stored in the DFE 50.

A controller of the host device 10 acquires the surface effect selection table from the printing apparatus 30 at a predetermined timing, and generates (copies) the density value selection table from the acquired surface effect selection table and stores it in the storage unit. Although FIG. 5 illustrates the example of the density value selection table in a simplified manner, the correspondence between the types of the surface effects and the density values that is specified in the density value selection table is actually the same as the correspondence between the types of the surface effects and the density values that is described in the surface effect selection table, which will be described later.

It should be noted that the surface effect selection table, which will be described later, may be stored in a storage server (cloud) on a network such as the Internet. In this case, the controller of the host device 10 only needs to acquire the surface effect selection table from the server and generates (copies) the density value selection table from the acquired surface effect selection table. The correspondences between the types of the surface effects and the density values in the surface effect selection table stored in the DFE 50 and in the density value selection table stored in the storage unit of the host device 10 need to be the same.

The image processing application of the host device 10 generates the first gloss control plane data by setting, to the drawing objects to which the user has specified predetermined surface effects (that is, gloss regions to which the surface effects are applied), the density values corresponding to the specified types of the surface effects with reference to the density value selection table as illustrated in FIG. 5.

For example, the case where the user has specified to apply "PG" to the region displaying "ABC", apply "G" to the region of the oblong shape, and apply "M" to the region of the circular shape in the target image as the first color plane data as illustrated in FIG. 2 is assumed. In this case, the host device 10 sets the density value of the drawing object ("ABC") to which the user has specified "PG" to the pixel value corresponding to "98%", the density value of the drawing object ("oblong shape") to which the user has specified "G" to the pixel value corresponding to "90%", and the density value of the drawing object ("circular shape") to which the user has specified "M" to the pixel value corresponding to "16%" with reference to the density value selection table so as to generate the first gloss control plane data.

The first gloss control plane data generated by the host device 10 is data in a vector format that is expressed as a set of coordinates of points, parameters of equations of lines and surfaces connecting the points, and the drawing objects indicating painting and special color effects.

FIG. 4 is a view illustrating the first gloss control plane data as an image and FIG. 6 is a table illustrating a correspondence relation among the drawing objects, coordinates, and the density values in the first gloss control plane data of FIG. 4.

The host device 10 generates the print data including the first gloss control plane data, the pieces of first color plane data, and a job command. The job command includes type information. For example, the job command may include pieces of information of various types such as commands to specify setting of the printer, setting of aggregation, setting of both-side printing, and the like to the printer.

The type information indicates normal printing or test printing. The test printing indicates image formation in order to check a print state. The normal printing indicates image formation based on the print data.

Figure 7:
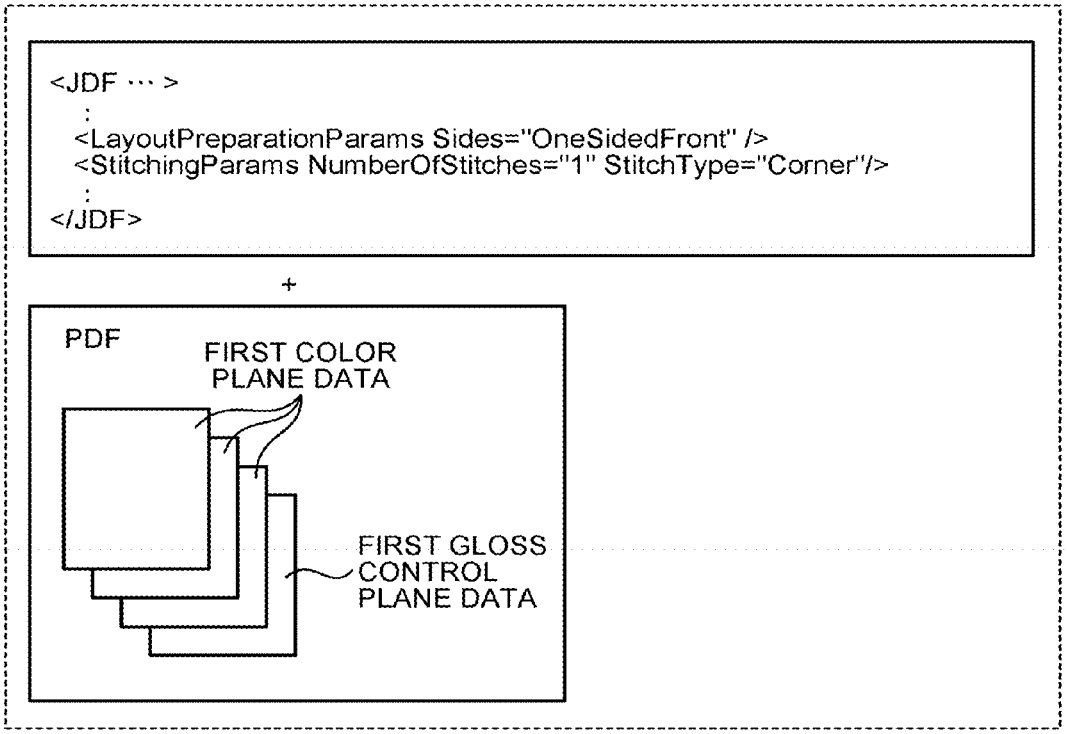
FIG. 7 is a plan view schematically illustrating an example of a structure of print data conceptually.

FIG. 7 is a plan view schematically illustrating an example of the structure of the print data conceptually. Although a job specification format (JDF) is used for the job command in the example of FIG. 7, the job command is not limited thereto. The JDF as illustrated in FIG. 7 is a command to specify "one-side printing with staple" as the setting of aggregation. Although not illustrated in FIG. 7, the job command includes the type information indicating the normal printing or the test printing.

The print data may be converted into a page description language (PDL) such as PostScript (registered trademark) or may be in the PDF format as long as the DFE 50 can handle it.

Figure 8:
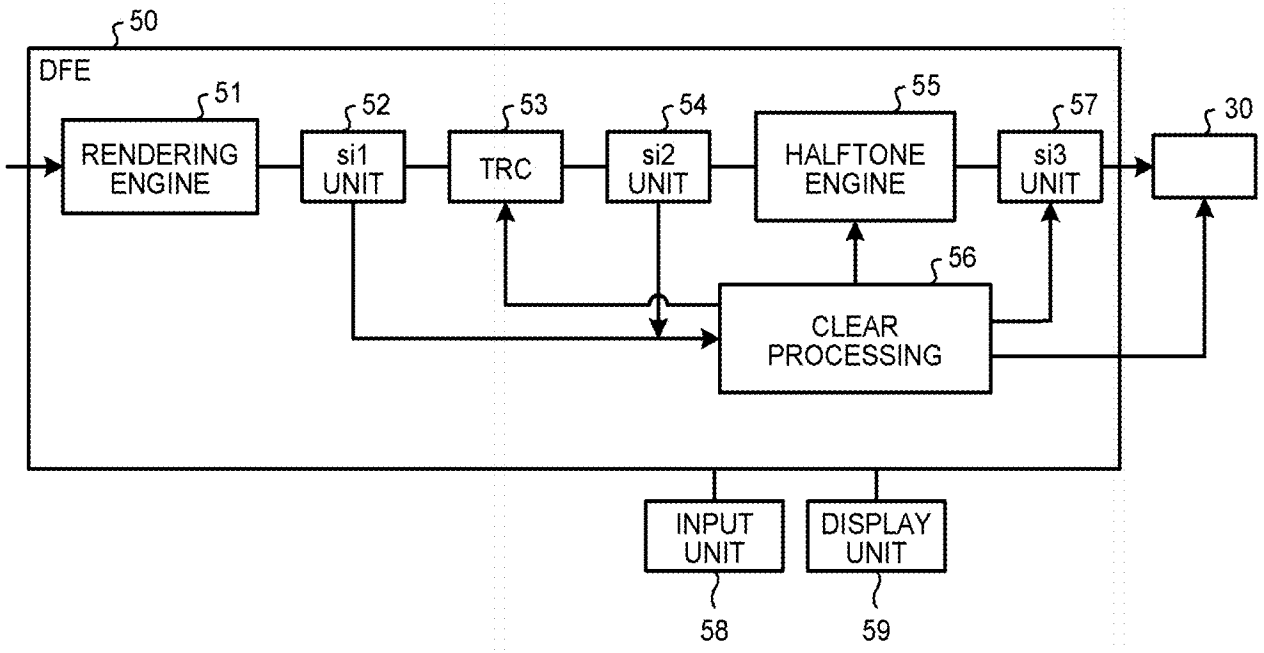
FIG. 8 is a block diagram illustrating the functional configuration of a DFE.

Next, the functional configuration of the DFE 50 will be described. FIG. 8 is a block diagram illustrating the functional configuration of the DFE 50. The DFE 50 corresponds to an image processing apparatus.

The DFE 50 includes a rendering engine 51, a si1 unit 52, a tone reproduction curve (TRC) 53, a si2 unit 54, a halftone engine 55, a clear processing 56, and a si3 unit 57.

The controller of the DFE 50 executes programs of various types that are stored in a main storage unit or an auxiliary storage unit so as to operate the rendering engine 51, the si1 unit 52, the TRC 53, the si2 unit 54, the halftone engine 55, the clear processing 56, and the si3 unit 57.

That is to say, some or all of the rendering engine 51, the si1 unit 52, the TRC 53, the si2 unit 54, the halftone engine 55, the clear processing 56, and the si3 unit 57 may be made to operate by causing a processing device such as a central processing unit (CPU) to execute programs, that is, by software, by hardware such as an integrated circuit (IC), or by software and hardware in combination, for example.

All of the si1 unit 52, the si2 unit 54 and the si3 unit 57 have a function of separating image data and a function of integrating the image data.

The rendering engine 51 receives the print data transmitted from the host device 10. The rendering engine 51 converts the vector format of each of the first gloss control plane data and the pieces of first color plane data included in the input print data into a raster format. The rendering engine 51 converts a color space represented by the RGB format or the like into a color space represented by the CMYK format for the pieces of first color plane data.

With this processing, the rendering engine 51 generates pieces of first color plane data of 8 bits of CMYK and first gloss control plane data of 8 bits and outputs them to the si1 unit 52. It should be noted that the pieces of first color plane data of 8 bits of CMYK and the first gloss control plane data of 8 bits are pieces of image data in which pixel values of the respective pixels are expressed by 8 bits.

That is to say, the rendering engine 51 converts the first gloss control plane data received from the host device 10 into the first gloss control plane data of 8 bits in which the types of the surface effects for the drawing objects that have been designated by the user are set as the density values for the respective pixels. The rendering engine 51 also outputs the type information included in the print data received from the host device 10 to the si1 unit 52.

The si1 unit 52 outputs the pieces of first color plane data of 8 bits of CMYK and the type information to the TRC 53. The si1 unit 52 outputs the first gloss control plane data of 8 bits and the type information to the clear processing 56.

The TRC 53 receives the pieces of first color plane data of 8 bits of CMYK from the si1 unit 52. The TRC 53 performs image processing such as gamma correction with a gamma curve of 1D_LUT generated by calibration on the pieces of first color plane data of 8 bits of CMYK. The image processing includes toner total amount restriction in addition to the gamma correction. The total amount restriction is processing of restricting the pieces of first color plane data of 8 bits of CMYK after the gamma correction because a toner amount capable of adhering to one pixel on the recording medium by the printer 70 is limited. The TRC 53 receives a total amount restriction value from the clear processing 56 and restricts the pieces of first color plane data of 8 bits of CMYK such that a total amount of colorants (toners in the embodiment) to be applied to each pixel is equal to or smaller than the received total amount restriction value.

The si2 unit 54 outputs the pieces of first color plane data of 8 bits of CMYK on which the TRC 53 has performed the gamma correction as pieces of data for generating an inverse mask (which will be described later) to the clear processing 56. In addition, the si2 unit 54 outputs the pieces of color plane data of 8 bits of CMYK on which the gamma correction has been performed and the type information to the halftone engine 55.

The halftone engine 55 receives the pieces of first color plane data of 8 bits of CMYK after the gamma correction and the type information from the si2 unit 54.

The halftone engine 55 converts the pieces of first color plane data of 8 bits of CMYK that have been received from the si2 unit 54 into pieces of colored colorant plane data of 2 bits of CMYK to be output to the printer 70 when the received type information indicates the normal printing.

For example, when the received type information indicates the normal printing, the halftone engine 55 performs halftone processing on the pieces of first color plane data of 8 bits of CMYK after the gamma correction and converts the data format thereof into a data format of pieces of colored colorant plane data of 2 bits of CMYK in which the pixel values of the respective pixels are expressed by 2 bits. It should be noted that 2 bits is an example and is not limiting. Then, the halftone engine 55 outputs the pieces of colored colorant plane data of 2 bits of CMYK to the si3 unit 57.

The pieces of colored colorant plane data are pieces of data in order to cause the color toners (colored colorants) to adhere to the recording medium on the printing apparatus 30 and are pieces of data for forming a color image that are described in a data format capable of being interpreted by the printing apparatus 30 (in the embodiment, the printer 70).

On the other hand, the halftone engine 55 converts pieces of first color plane data (details thereof will be described later) of 8 bits of CMYK that have been received from the clear processing 56 into pieces of colored colorant plane data when the received type information indicates the test printing. Then, the halftone engine 55 outputs the converted pieces of colored colorant plane data of 2 bits of CMYK to the si3 unit 57.

The clear processing 56 receives the first gloss control plane data of 8 bits and the type information from the si1 unit 52. Furthermore, the clear processing 56 receives the pieces of first color plane data of 8 bits of CMYK on which the gamma correction has been performed from the si2 unit 54.

The clear processing 56 generates special color colorant plane data using the first gloss control plane data of 8 bits and the pieces of first color plane data of 8 bits of CMYK on which the gamma correction has been performed. The special color colorant plane data is data in order to cause the special color toner (special color colorant) to adhere in the printing apparatus 30. The clear processing 56 will be described in detail later. In addition, the clear processing 56 also generates On/Off information indicating On or Off for the glosser 80.

Thereafter, the clear processing 56 outputs the generated special color colorant plane data of 2 bits and the On/Off information for the glosser 80 to the si3 unit 57. The si3 unit 57 outputs output data including the pieces of colored colorant plane data of 2 bits of CMYK that have been received from the halftone engine 55, and the special color colorant plane data of 2 bits and the On/Off information for the glosser 80 that have been received from the clear processing 56 to the printing apparatus 30 through the MIC 60 (see FIG. 1).

Figure 9:
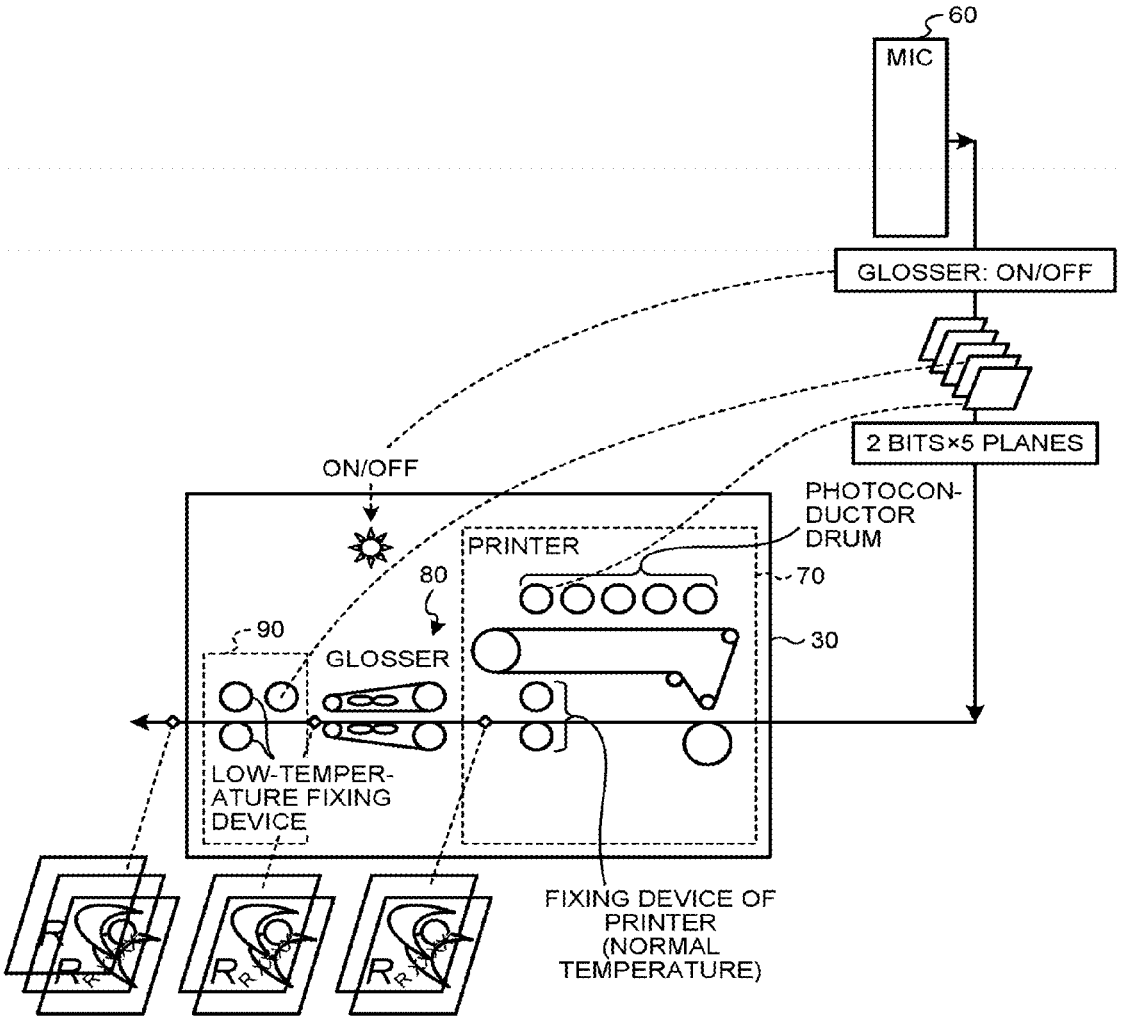
FIG. 9 is a plan view schematically illustrating a mechanism interface controller (MIC) and a printing apparatus.

Referring back to FIG. 1, the MIC 60 outputs the output data to the printing apparatus 30. FIG. 9 is a plan view schematically illustrating the MIC 60 and the printing apparatus 30.

The MIC 60 distributes the pieces of colored colorant plane data and the special color colorant plane data (actually, the special color colorant plane data for the printer 70 and the special color colorant plane data for the low-temperature fixing device 90) that are included in the received output data to the corresponding printer 70 and the low-temperature fixing device 90. The MIC 60 controls to turn On or Off the glosser 80 in accordance with the On/Off information included in the output data.

The printing apparatus 30 configured by the printer 70, the glosser 80, and the low-temperature fixing device 90 includes a conveyance path for conveying the recording medium. The printer 70 specifically includes a plurality of photoconductors of the electrophotography system, a transfer belt onto which toner images formed on the photoconductors are transferred, a transfer device that transfers the toner images on the transfer belt onto the recording medium, and a fixing device that fixes the toner images on the recording medium onto the recording medium. The recording medium is conveyed on the conveyance path by a conveying member (not illustrated) so as to be conveyed through the positions at which the printer 70, the glosser 80, and the low-temperature fixing device 90 are provided in this order. These devices perform pieces of processing sequentially and image formation and application of the surface effects are made on the recording medium. Thereafter, the recording medium is conveyed on the conveyance path by a conveying mechanism (not illustrated) and is discharged to the outside of the printing apparatus 30.

Next, the clear processing 56 will be described in detail.

Figure 10:
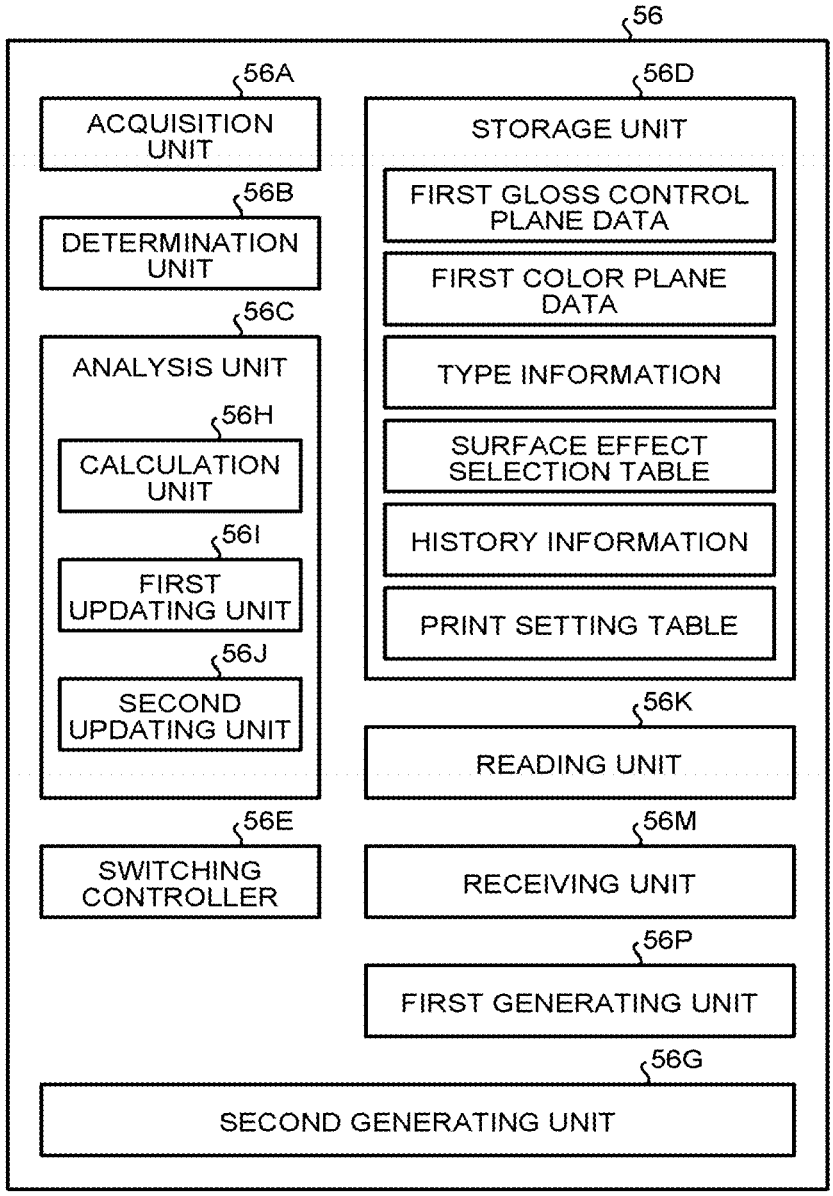
FIG. 10 is a functional block diagram illustrating clear processing.

FIG. 10 is a functional block diagram illustrating the clear processing 56. The clear processing 56 includes an acquisition unit 56A, a determination unit 56B, an analysis unit 56C, a storage unit 56D, a switching controller 56E, a reading unit 56K, a receiving unit 56M, a first generating unit 56P, and a second generating unit 56G. The analysis unit 56C includes a calculation unit 56H, a first updating unit 56I, and a second updating unit 56J.

Some or all of the acquisition unit 56A, the determination unit 56B, the analysis unit 56C, the storage unit 56D, the switching controller 56E, the second generating unit 56G, the calculation unit 56H, the first updating unit 56I, the second updating unit 56J, the reading unit 56K, the receiving unit 56M, and the first generating unit 56P may be made to operate by causing a processing device such as a CPU to execute programs, that is, by software, by hardware such as an IC, or by software and hardware in combination.

The acquisition unit 56A acquires the type information, the first gloss control plane data, and the pieces of first color plane data from the si1 unit 52 and the si2 unit 54.

To be specific, the acquisition unit 56A acquires the print data including the first gloss control plane data of 8 bits, the pieces of first color plane data of 8 bits of CMYK on which the gamma correction has been performed, and the type information.

The first gloss control plane data of 8 bits is the image data specifying the density values for identifying the types of the surface effects as visual or tactile effects on the recording medium and gloss regions on the recording medium to which the surface effects are applied as described above. The type information indicates the normal printing or the test printing.

The acquisition unit 56A stores these pieces of data (the first gloss control plane data of 8 bits, the pieces of first color plane data of 8 bits of CMYK, and the type information) in the storage unit 56D.

The storage unit 56D stores therein pieces of data of various types. In the embodiment, the storage unit 56D previously stores therein the surface effect selection table. In addition, the storage unit 56D stores therein history information. The history information will be described later with reference to FIG. 12.

It should be noted that the surface effect selection table and the history information may be stored in storage media of various types such as a storage server (cloud) on a network such as the Internet, an external storage medium, and an external storage device. In this case, the clear processing 56 only needs to read or update the surface effect selection table and the history information from these storage media. With this storage manner, these pieces of information (the surface effect selection table and the history information) can be shared among a plurality of image formation apparatuses.

The surface effect selection table is information in which the density values indicating the surface effects as the visual or tactile effects on the recording medium, the types of the surface effects, and types of linkage effects as other surface effects related to the types of the surface effects are associated with one another.

The surface effect selection table only needs to associate these pieces of data with one another and a data format thereof is not limited to the table. For example, the surface effect selection table may be a database that associates these pieces of data with one another.

FIG. 11 is a diagram illustrating an example of the data format of the surface effect selection table.

As illustrated in FIG. 11, the surface effect selection table is data in which the density values, the types of the surface effects, the pieces of On/Off information, specification contents, and the linkage effect types are associated with one another in the embodiment.

The specification content is information indicating a type of an image that the printing apparatus 30 forms using the special color toner. Examples of the specification content include information indicating a halftone image of halftone 0% or 12% to 100%, information indicating a tile character string, information indicating a tile ground pattern, information indicating a tile mesh designed pattern, and information indicating a solid image. It should be noted that the specification contents are not limited thereto.

The printing apparatus 30 applies the special color toner in accordance with the specification content specified in the special color colorant plane data. With the application of the special color toner, an image (image with the special color toner) of a type indicated by the specification contents is formed on the recording medium.

In the example as illustrated in FIG. 11, the specification content of the special color colorant plane data includes a specification content of the special color colorant plane data (see, clear toner plane 1) that is used in the printer 70 and a specification content of the special color colorant plane data (see, clear toner plane 2) that is used in the low-temperature fixing device 90.

The density values specified in the surface effect selection table indicate the surface effects like the density values specified in the above-mentioned first gloss control plane data.

The example illustrated in FIG. 11 indicates, as the density values, ranges of values for every pixel value "6" when the density values are represented by values (0 to 255) expressed by 8 bits, representative values in the respective ranges of the values, and values when the representative values are expressed by a percentage unit of 0 to 100%. The values expressed by the percentage unit are values when the density value "0" is set to "0%" and the density value "255" is set to "100%".

To be specific, in the example as illustrated in FIG. 11, the individual types of the surface effects are associated with ranges (every 6) of the density values (0 to 255) expressed by 8 bits in the surface effect selection. Furthermore, the individual types of the surface effects are associated with the percentages of the density values that are calculated from the representative values in the respective ranges of the density values in increments of 2%. The surface effects providing gloss (premium gloss and gloss) are associated with ranges ("212" to "255") of the density values in which values (assumed to be gloss control ratios) when the density values are expressed by the percentage unit are equal to or higher than 84% and the surface effects reducing gloss (matt and premium matt) are associated with ranges ("1" to "43") of the density values in which the gloss control ratios are equal to or lower than 16%. The surface effects such as texture and ground pattern watermark are associated with ranges of the density values in which the gloss control ratios are 20% to 80%.

To be more specific, for example, the premium gloss (PM) as the surface effect is associated with the density values of "238" to "255". Different types of the premium gloss are associated with three ranges of the density values of "238" to "242", the density values of "243" to "247", and the density values of "248" to "255". The gloss (G) is associated with the density values of "212" to "232". Different types of the gloss are associated with four ranges of the density values of "212" to "216", the density values of "217" to "221", the density values of "222" to "227", and the density values of "228" to "232". The matt (M) is associated with the density values of "23" to "43". Different types of the matt are associated with four ranges of the density values of "23" to "28", the density values of "29" to "33", the density values of "34" to "38", and the density values of "39" to "43". The premium matt (PM) is associated with the density values of "1" to "17". Different types of the premium matt are associated with three ranges of the density values of "1" to "7", the density values of "8" to "12", and the density values of "13" to "17". These different types of the same surface effects are different in the equation for providing the pieces of special color colorant plane data that are used in the printer 70 and the low-temperature fixing device 90 and are the same in operations of the printing apparatus 30. Application of no surface effect is associated with the density value of "0".

In the example as illustrated in FIG. 11, the pieces of On/Off information indicating On or Off of the glosser 80, the specification contents of the special color colorant plane data (clear toner plane 1) that is used in the printer 70, and the specification contents of the special color colorant plane data (clear toner plane 2) that is used in the low-temperature fixing device 90 are indicated in association with the density values and the types of the surface effects in the surface effect selection table.

For example, when the type of the surface effect is the premium gloss, the glosser 80 is turned On, the special color colorant plane data that is used in the printer 70 indicates an inverse mask, and there is no special color colorant plane data that is used in the low-temperature fixing device 90. The inverse mask is obtained by an equation (1), which will be described later, for example.

The inverse mask is a mask that causes the total adhesion amounts of the color toners of CMYK and the special color toner on the respective pixels forming a target region to which the surface effect is applied to be made uniform. To be specific, image data obtained by adding all the density values of the pixels forming the target region in the pieces of first color plane data of 8 bits of CMYK and subtracting the added values from a predetermined value corresponds to the inverse mask.

For example, the inverse mask is expressed by the following equation (1).

$$Clr=100-(C+M+Y+K) \text{ where } Clr=0 \text{ in the case of } Clr<0 \quad (1)$$

In the equation (1), Clr, C, M, Y, and K indicate density ratios calculated from the density values on the respective pixels for the special color toner and the respective color toners of C, M, Y, and K, respectively.

That is to say, the total adhesion amount calculated by adding an adhesion amount of the special color toner to the total adhesion amount of the color toners of C, M, Y, and K is set to 100% for all the pixels forming the target region to which the surface effect is applied in accordance with the equation (1). When the total adhesion amount of the color toners of C, M, Y, and K is equal to or higher than 100%, the special color toner is not made to adhere and the density ratio thereof is set to 0%. This is because a portion on which the total adhesion amount of the color toners of C, M, Y, and K is higher than 100% is smoothened by fixing processing. Thus, irregularities on the surface due to difference in the total adhesion amount are eliminated on the target region by setting the total adhesion amounts on all the pixels forming the target gloss region to which the surface effect is applied to equal to or higher than 100%. As a result, gloss by regular reflection of light is generated. Note that there are inverse masks obtained by equations other than the equation (1) and there can be a plurality of types of the inverse masks.

For example, the inverse mask may be a mask that causes the special color toner to adhere to the individual pixels uniformly. The inverse mask in this case is also referred to as a solid mask and is expressed by the following equation (2).

$$Clr=100 \quad (2)$$

In the equation (2) and the following equations (3) and (4), Clr indicates a density ratio of the special color toner that is calculated from the density value on each pixel.

There may be a pixel with which the density ratio other than 100% is associated among the target pixels to which the surface effect is applied and there can be a plurality of solid mask patterns.

For example, the inverse mask may be obtained by multiplication of background exposure ratios of the respective colors. The inverse mask in this case is expressed by the following equation (3), for example.

$$Clr=100\times\{(100-C)/100\}\times\{(100-M)/100\}\times\{(100-Y)/100\}\times\{(100-K)/100\} \quad (3)$$

In the above-mentioned equation (3), (100−C)/100 indicates a background exposure ratio of C, (100−M)/100 indicates a background exposure ratio of M, (100−Y)/100 indicates a background exposure ratio of Y, and (100−K)/100 indicates a background exposure ratio of K.

For example, the inverse mask may be a mask that is obtained by a method with an assumption that a halftone dot of a maximum area ratio establishes smoothness. The inverse mask in this case is expressed by the following equation (4), for example.

$$Clr=100-\max(C,M,Y,K) \quad (4)$$

In the above-mentioned equation (4), max(C, M, Y, K) indicates that the density value of a color indicating a maximum density value among the density values of CMYK is a representative value.

That is to say, the inverse mask only needs to be expressed by any one of the above-mentioned equations (1) to (4).

Referring back to FIG. 11, when the density value is "228" to "232" and the type of the surface effect is the gloss, the glosser 80 is turned Off, the special color colorant plane data (clear toner plane 1) that is used in the printer 70 indicates an inverse mask 1, and there is no special color colorant plane data (clear toner plane 2) that is used in the low-temperature fixing device 90.

The inverse mask 1 only needs to be expressed by any one of the above-mentioned equations (1) to (4). The total adhesion amount of the toners that are smoothened is not uniform because the glosser 80 is in the Off state. Due to the non-uniformity, the irregularities on the surface are increased in comparison with the premium gloss and gloss having lower glossiness than that of the premium gloss is obtained, as a result. Furthermore, when the type of the surface effect is the matt, the glosser 80 is turned Off, the special color colorant plane data (clear toner plane 1) that is used in the printer 70 indicates halftone (halftone dots), and there is no special color colorant plane data (clear toner plane 2) that is used in the low-temperature fixing device 90. When the type of the surface effect is the premium matt, the glosser 80 may be turned On or Off, there is no special color colorant plane data (clear toner plane 1) that is used in the printer 70, and the special color colorant plane data (clear toner plane 2) that is used in the low-temperature fixing device 90 indicates a solid mask. The solid mask is obtained by the above-mentioned equation (2), for example.

In the embodiment, types of linkage effects as other surface effects related to the corresponding types of the surface effects are registered in association with the respective types of the surface effects in the surface effect selection table, as described above.

In the example as illustrated in FIG. 11, the linkage effects of one to three types are associated with the surface effect of each type, as an example. It should be noted that the linkage effects of equal to or more than four types may be associated with the surface effect of each type and the linkage effects are not limited to be equal to or less than three types. Furthermore, the invention is not limited to a mode in which the linkage effect of at least equal to or more than one type is associated with each of all the types of the surface effects that are registered in the surface effect selection table. That is to say, the surface effect selection table may include a type of the surface effect with which no linkage effect type is associated.

Each linkage effect type may be a surface effect that is similar to the corresponding type of the surface effect or may be a surface effect that is non-similar to the corresponding type of the surface effect. It should be noted that the analysis unit 56C (second updating unit 56J), which will be described later, updates these linkage effect types (details thereof will be described later).

Subsequently, the history information will be described.

FIG. 12 is a view illustrating an example of a data format of the history information. As illustrated in FIG. 12, the history information is information in which the types of the surface effects and pieces of analysis information are associated with each other. The analysis unit 56C (first updating unit 56I), which will be described later, updates the history information.

The types of the surface effects that are indicated in the history information are types of the surface effects specified in the first gloss control plane data.

The analysis information is information indicating an analysis result of a usage condition of the surface effect. The analysis information includes a plurality of analysis items indicating analysis contents. In the embodiment, the analysis information includes the number of times of usage and an average area. The analysis information only needs to be information indicating the analysis result of the usage condition of the surface effect and is not limited to the number of times of usage and the average area.

The number of times of usage indicates the number of times of usage of the type of the surface effect in the first gloss control plane data. The number of times of usage is a value calculated by counting a continuous region to which the surface effect of the same type is specified as one (once as the number of times of usage) in the first gloss control plane data. The average area indicates the average area of gloss regions of the surface effect of the corresponding type per usage.

The history information may be analysis information of the pieces of first gloss control plane data included in the pieces of output data acquired in the past by the clear processing 56 or may be analysis information in the pieces of first gloss control plane data included in the pieces of output data acquired in a predetermined period (for example, the latest one month from the present time point) by the clear processing 56.

Referring back to FIG. 10, the determination unit 56B determines whether the type information included in the print data acquired by the acquisition unit 56A indicates the normal printing or the test printing.

The analysis unit 56C analyzes the first gloss control plane data included in the print data acquired by the acquisition unit 56A, analyzes the history information, and so on so as to update the surface effect selection table.

To be specific, the analysis unit 56C includes the calculation unit 56H, the first updating unit 56I, and the second updating unit 56J.

When the type information included in the print data acquired by the acquisition unit 56A indicates the normal printing, the calculation unit 56H calculates the analysis information in the first gloss control plane data. In the embodiment, the calculation unit 56H calculates the numbers of times of usage of the types of the surface effects in the first gloss control plane data and the areas of the gloss regions corresponding to the types of the surface effects in the first gloss control plane data as the analysis information.

To be specific, the calculation unit 56H calculates the analysis information that is used to update the history information from the first gloss control plane data acquired by the acquisition unit 56A. First, the calculation unit 56H reads the types of the surface effects corresponding to the density values of the respective pixels that are specified in the first gloss control plane data acquired by the acquisition unit 56A from the surface effect selection table. Then, the calculation unit 56H calculates the numbers of surface effects of respective types included in the first gloss control plane data by counting pixel groups in which pixels with the same type of the surface effect (that is to say, density values corresponding to the same type of the surface effect) are continuously arranged as one gloss region. Furthermore, the calculation unit 56H calculates the calculated numbers of surface effects of the respective types included in the first gloss control plane data as the numbers of times of usage of the respective types of the surface effects.

Thereafter, the calculation unit 56H calculates the areas of the gloss regions corresponding to the respective types of the surface effects that are included in the first gloss control plane data. The calculation unit 56H calculates the areas of the gloss regions corresponding to the respective types of the surface effects by counting the numbers of pixels forming the same types of the surface effects that are included in the first gloss control plane data, for example.

The first updating unit 56I updates the history information in accordance with the calculation result by the calculation unit 56H.

In the embodiment, the first updating unit 56I receives the numbers of times of usage of the types of the surface effects in the first gloss control plane data and the areas of the gloss regions corresponding to the types of the surface effects that have been calculated by the calculation unit 56H.

The history information is stored in such a manner that the numbers of times of usage, the average areas, and cumulative values of the areas of the corresponding gloss regions are associated with one another as the analysis information.

The first updating unit 56I registers, in the history information, added values calculated by adding the numbers of times of usage of the types of the surface effects that have been calculated by the calculation unit 56H to the numbers of times of usage of the respective types of the surface effects in the history information. With this registration, the first updating unit 56I updates the numbers of times of usage in the history information.

Furthermore, the first updating unit 56I calculates the added values (referred to as area added values) by adding the areas of the gloss regions corresponding to the types of the surface effects that have been calculated by the calculation unit 56H to the cumulative values of the areas of the gloss regions corresponding to the respective types of the surface effects in the history information. Then, the first updating unit 56I calculates values obtained by dividing the area added values by the numbers of times of usage of the corresponding types of the surface effects as the average areas. Subsequently, the first updating unit 56I registers the calculated average areas in association with the corresponding types of the surface effects in the history information. With the registration, the first updating unit 56I updates the average areas in the history information.

The first updating unit 56I may reset (set values to "0") the numbers of times of usage, the average areas, and the cumulative values of the areas of the gloss regions that are registered in the history information for every period (for example, one week, one month, half year) specified in advance by the user. In this case, the history information is information indicating history of the analysis results of the pieces of first gloss control plane data every previously specified period.

Alternatively, the first updating unit 56I may reset the numbers of times of usage, the average areas, and the cumulative values of the areas of the gloss regions that are registered in the history information every time the acquisition unit 56A acquires the print data. In this case, the history information is information indicating history of the analysis result of the first gloss control plane data for each print data.

The analysis information that is registered in the history information may be set so as to be deleted in the order from old information after a constant period has elapsed. The setting can also be changed by the user.

The second updating unit 56J selects other types of the surface effects to be linked to the respective types of the surface effects in accordance with the history information updated by the first updating unit 56I and registers the selected other types of the surface effects as the linkage effect types corresponding to the respective types of the surface effects. With the registration, the second updating unit 56J updates the surface effect selection table.

For example, the second updating unit 56J selects other types of the surface effects that are similar to or non-similar to the respective types of the surface effects in accordance with the history information. To be "similar" indicates that values indicated by the analysis information are identical or different by being smaller than thresholds. To be "non-similar" indicates that the values indicated by the analysis information are not identical and different by being equal to or larger than the thresholds. The thresholds only need to be previously determined in accordance with the types of the pieces of information (for example, the number of times of usage, average area) included in the analysis information.

The second updating unit 56J may select other types of the surface effects that are similar to (for example, the most similar to) and are non-similar to (for example, the least similar to) the respective types of the surface effects in accordance with the history information.

Then, the second updating unit 56J registers the selected other types of the surface effects as linkage effect types corresponding to the respective types of the surface effects so as to update the surface effect selection table. It is sufficient, that whether the similar or non-similar other types of the surface effects or the similar and non-similar other types of the surface effects are selected, are set in advance by an operation instruction with the input unit 58 (see FIG. 8) by the user. With this setting, the user can determine how far the usage history is tracked back and utilized when the linkage effects are generated automatically. Then, the second updating unit 56J only needs to select the similar or non-similar or both of the similar and non-similar other types of the surface effects to the respective types of the surface effects in accordance with the setting contents (similar or non-similar or both of the similar and non-similar). Furthermore, a range of the usage history (period (for example, pieces of information for the latest one month)) to be used when the linkage effects are generated automatically only needs to be set in advance by an operation instruction with the input unit 58 by the user. In this case, the second updating unit 56J can generate the linkage effects automatically utilizing the range designated by the user in the usage history.

Figure 13:
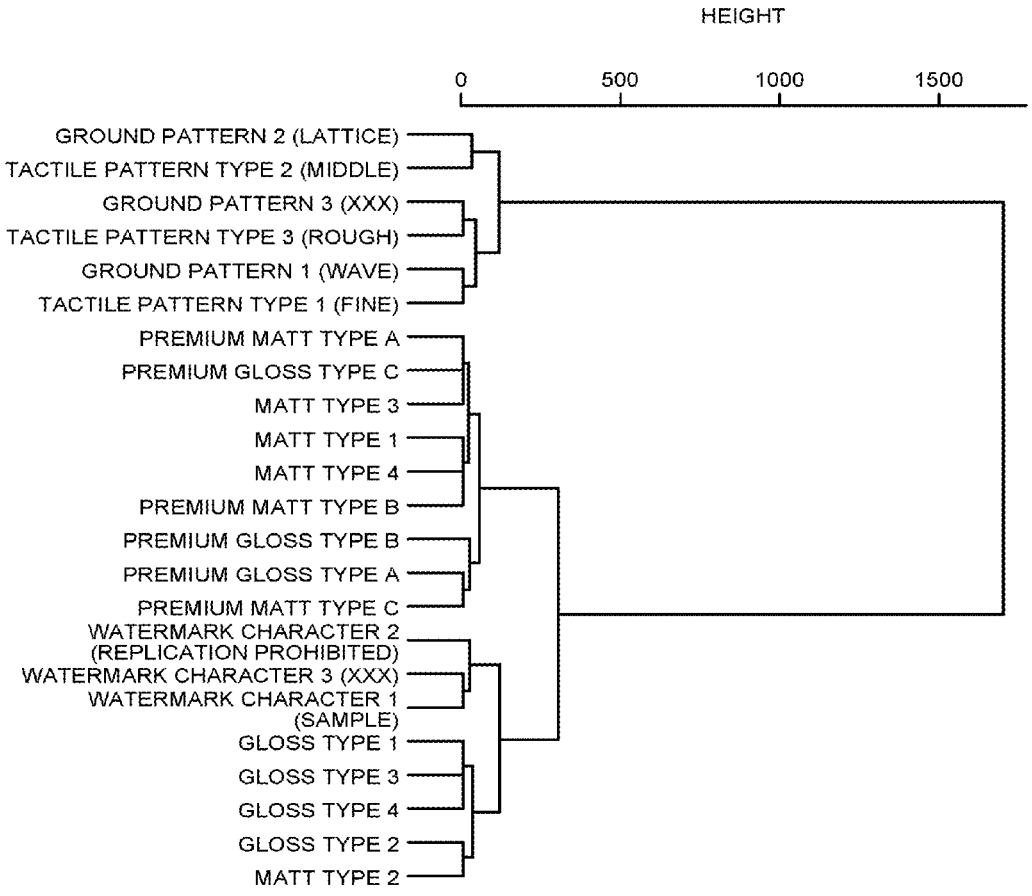
FIG. 13 is a diagram illustrating an example of a method of selecting other types of the surface effects.

FIG. 13 is a diagram illustrating an example of a method of selecting other types of the surface effects to be linked to the respective types of the surface effects by the second updating unit 56J. FIG. 13 illustrates an example of the method of selecting other types of the surface effects to be linked by analyzing the history information as illustrated in FIG. 12 by cluster analysis.

For example, the second updating unit 56J performs cluster analysis using the numbers of times of usage and the average areas for the respective types of the surface effects that are indicated in the history information (see FIG. 12). The cluster analysis is a method of classifying targets by forming clusters by collecting similar pieces of data among mixed pieces of data having a different property as the targets. A well-known method only needs to be used for the cluster analysis. The cluster analysis causes the second updating unit 56J to classify the types of the surface effects based on clusters formed by grouping the types of the surface effects having high similarity in the corresponding analysis information.

For example, in the embodiment, the second updating unit 56J classifies the types of the surface effects having the numbers of times of usage and the average areas both the values of which are identical to each other or different by being smaller than the thresholds as similar types of the surface effects.

For example, in the example as illustrated in FIG. 13, pieces of analysis information of a type of the surface effect "watermark character 1 (sample)" and a type of the surface effect "watermark character 3 (XXX)" are identical to each other. In this case, the second updating unit 56J classifies the type of the surface effect "watermark character 1 (sample)" and the type of the surface effect "watermark character 3 (XXX)" into a cluster having high similarity in the analysis information.

The type of the surface effect "watermark character 1 (sample)" and a type of the surface effect "ground pattern 1 (wave)" are equal to or larger than 10 times different in the average area. In this case, the second updating unit 56J classifies the type of the surface effect "watermark character 1 (sample)" and the type of the surface effect "ground pattern 1 (wave)" into a non-similar cluster (having low similarity).

In this manner, the second updating unit 56J classifies the types of the surface effects so as to be grouped based on similarity. With this classification, the second updating unit 56J selects other types of the surface effects to be linked to the respective types of the surface effects.

As described above, the second updating unit 56J may classify the types of the surface effects into clusters formed by grouping the (non-similar) types of the surface effects having low similarity in the usage manner and select non-similar other types of the surface effects as the types of the surface effects to be linked.

The second updating unit 56J only needs to select at least one other type of the surface effect as the linkage effect type corresponding to each type of the surface effect.

Then, the second updating unit 56J registers the (an)other types of the surface effects selected for the respective types of the surface effects as the linkage effect types in the surface effect selection table so as to update the surface effect selection table.

That is to say, the second updating unit 56J updates the linkage effect types corresponding to the respective types of the surface effects in the surface effect selection table in accordance with the pieces of analysis information that are indicated in the latest history information.

An update timing by the second updating unit 56J can be appropriately changed by an operation instruction with the input unit 58 by the user. For example, the second updating unit 56J only needs to execute the above-mentioned updating processing every time the acquisition unit 56A acquires the print data by setting a print data unit (also referred to as a job unit in some cases) as the update timing. When a predetermined period (for example, one week and one month) is set as the update timing, the second updating unit 56J only needs to execute the updating processing every predetermined period. In the embodiment, the second updating unit 56J executes the updating processing every time the acquisition unit 56A acquires the print data, as an example.

The second updating unit 56J may change at least a part of the linkage effect types that are registered in the surface effect selection table or register a new linkage effect type by an operation instruction with the input unit 58 by the user. When the user desires to change the linkage effect type updated in accordance with the history information by the second updating unit 56J, the linkage effect type registered in the surface effect selection table can be changed appropriately.

Referring back to FIG. 10, the reading unit 56K reads the types of the surface effects corresponding to the densify values specified in the first gloss control plane data included in the print data and the linkage effect types corresponding to the density values from the surface effect selection table when the determination unit 56B has determined that the type information indicates the test printing.

As described above, the density values, the types of the surface effects, the pieces of On/Off information, the specification contents of the pieces of special color colorant plane data, and the linkage effect types are associated with one another in the surface effect selection table (see FIG. 11).

The reading unit 56K reads the types of the surface effects and the linkage effect types that correspond to the density values specified in the first gloss control plane data from the surface effect selection table.

When the determination unit 56B has determined that the type information indicates the test printing, the receiving unit 56M receives designation of setting information indicating the print setting, on the recording medium, for each of the gloss regions to which the surface effects are applied and the linkage regions to which the linkage effects are applied. The receiving unit 56M receives the designation of the setting information input by an operation instruction with the input unit 58 (see FIG. 8) by the user from the input unit 58.

The setting information includes print settings of various types related to printing of the gloss regions and the linkage regions on the recording medium. For example, the print settings are pieces of information indicating printing manners of the gloss regions in accordance with the types of the surface effects specified in the first gloss control plane data and the linkage regions in accordance with the linkage effect types corresponding to the types of the surface effects on the recording medium.

For example, the setting information includes first setting, second setting, third setting, fourth setting, fifth setting, and sixth setting.

The first setting is information indicating extraction of an overlapped region. To be specific, the first setting is information indicating extraction of the overlapped region overlapping the color image specified in the pieces of first color plane data and the gloss regions indicated by the first gloss control plane data.

The second setting is information indicating a printing speed. The second setting indicates any one of image quality priority or speed priority as the printing speed or indicates both of the image quality priority and the speed priority as the printing speed.

The third setting is information indicating that the gloss regions and the linkage regions are printed on the set number of the recording media. The number of recording media on which they are printed can be appropriately set by an operation instruction with the input unit 58 by the user.

The fourth setting is information indicating arrangement change and indicating rearrangement of the gloss regions in accordance with the types of the surface effects specified in the first gloss control plane data and the linkage regions of the linkage effect types corresponding to the types of the surface effects within the number of pages set in the third setting.

The fifth setting is information indicating aggregation and indicating that the gloss regions of the types of the surface effects specified in the first gloss control plane data formed by a plurality of pages and the linkage regions of the linkage effect types corresponding to the types of the surface effects are aggregated in the number of pages set in the third setting.

The sixth setting is information indicating that each of the gloss regions and the linkage regions is arranged so as to have a predetermined shape.

The user inputs the setting information including at least one of the first setting, the second setting, the third setting, the fourth setting, the fifth setting, and the sixth setting by operating the input unit 58.

For example, the storage unit 56D previously stores therein a print setting table in which pieces of On/Off information of the first setting to the sixth setting are combined.

FIG. 14 is a view illustrating an example of the print setting table. The print setting table is information in which pieces of identification information of the print settings and the pieces of setting information are associated with each other. The print setting table only needs to be information associating these pieces of information with each other and a data format thereof is not limited to the table. For example, the print setting table may be a database.

The identification information is information that uniquely identifies a combination of the pieces of On/Off information of the first setting to the sixth setting that are indicated by the corresponding setting information. The print setting table stores therein the pieces of On/Off information of the first setting to the sixth setting as the setting information.

When the corresponding On/Off information is "On" for each of the first setting to the sixth setting, the setting information includes the corresponding setting of the first setting to the sixth setting. On the other hand, when the corresponding On/Off information is "Off" for each of the first setting to the sixth setting, the setting information does not include the corresponding setting of the first setting to the sixth setting. When the On/Off information corresponding to the second setting indicating the printing speed is "On", the printing speed indicates both of the image quality priority and the speed priority. When the On/Off information corresponding to the second setting is "Off", the printing speed indicates any one of the image quality priority and the speed priority. In the embodiment, when the On/Off information corresponding to the second setting is "Off", the printing speed indicates the speed priority, as an example.

For example, the clear processing 56 displays the print setting table as illustrated in FIG. 14 and character information prompting the user to input any identification information on the display unit 59 (see FIG. 8). The user selects any identification information on the displayed print setting table by operating the input unit 58 so as to input the setting information.

For example, when identification information "4-1" is selected by an operation instruction with the input unit 58 by the user, the receiving unit 56M (see FIG. 10) of the clear processing 56 receives the third setting (designation of the number of recording media) and the fourth setting information (arrangement change) for which the pieces of On/Off information are "On" as the setting information corresponding to the identification information "4-1" in the print setting table.

The user may select arbitrary setting information among the first setting to the sixth setting by an operation instruction with the input unit 58 so as to input the setting information. That is to say, the combinations of the pieces of On/Off information of the setting information (the first setting to the sixth setting) that are registered in the print setting table as illustrated in FIG. 14 are examples and an arbitrary combination can be set.

Furthermore, the user may select the first setting to the sixth setting other than the combinations set in the print setting table by an operation instruction with the input unit 58 so as to input the setting information. This enables the user to easily check the surface effects with a printing method desired by the user.

Referring back to FIG. 10, the first generating unit 56P generates second gloss control plane data when the determination unit 56B has determined that the type information indicates the test printing.

The second gloss control plane data specifies each of the types of the surface effects and the gloss regions that are specified in the first gloss control plane data and the read linkage effect types corresponding to the types of the surface effects and the linkage regions to which the linkage effects are applied. In other words, the second gloss control plane data is data specifying both of the types of the surface effects and the gloss regions to which the types of the surface effects are applied that are specified in the first gloss control plane data, and the linkage effect types corresponding to the types of the surface effects specified in the first gloss control plane data and the linkage regions.

To be specific, the first generating unit 56P generates the second gloss control plane data specifying the density values (referred to as first density values in some cases) for specifying the types of the surface effects and the gloss regions to which the types of the surface effects are applied that are specified in the first gloss control plane data, and the density values (referred to as second density values in some cases) for specifying the linkage effect types corresponding to the types of the surface effects and the linkage regions to which the linkage effects are applied.

The first generating unit 56P acquires the second density values (density values of the linkage regions) in the following manner, for example. First, the first generating unit 56P reads the types of the surface effects the names of which are the same as the linkage effect types read by the reading unit 56K from the surface effect selection table (see FIG. 11). Then, the first generating unit 56P uses the density values corresponding to the read types of the surface effects in the surface effect selection table as the second density values for specifying the linkage effect types and the linkage regions.

The second gloss control plane data specifies the first density values for specifying the types of the surface effects and the gloss regions and the second density values for specifying the linkage effect types and the linkage regions for the respective pixels.

Moreover, the first generating unit 56P preferably generates the second gloss control plane data in accordance with the setting information received by the receiving unit 56M.

To be specific, first, suppose that the setting information received by the receiving unit 56M from the input unit 58 does not include any of the first setting to the sixth setting. This case corresponds to the case where the user inputs identification information "1" in the print setting table as illustrated in FIG. 14. That is to say, all of the pieces of On/Off information corresponding to the first setting to the sixth setting are "Off".

In this case, the first generating unit 56P generates the second gloss control plane data specifying, on different pages, the types of the surface effects and the gloss regions that are specified in the first gloss control plane data, and the linkage effect types corresponding to the types of the surface effects and having been read by the reading unit 56K and the linkage regions to which the linkage effects are applied in accordance with the setting information.

That is to say, the first generating unit 56P generates the second gloss control plane data including a page in which the gloss regions specified in the first gloss control plane data are arranged at positions specified in the first gloss control plane data, and a page in which the linkage regions are arranged at corresponding positions specified in the first gloss control plane data.

Figure 15A:
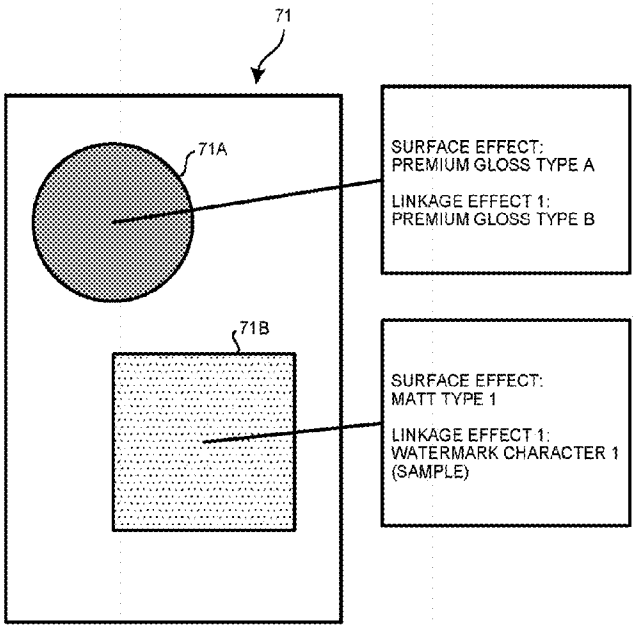
FIGS. 15A and 15B are descriptive views for explaining generation of second gloss control plane data.
Figure 15B:
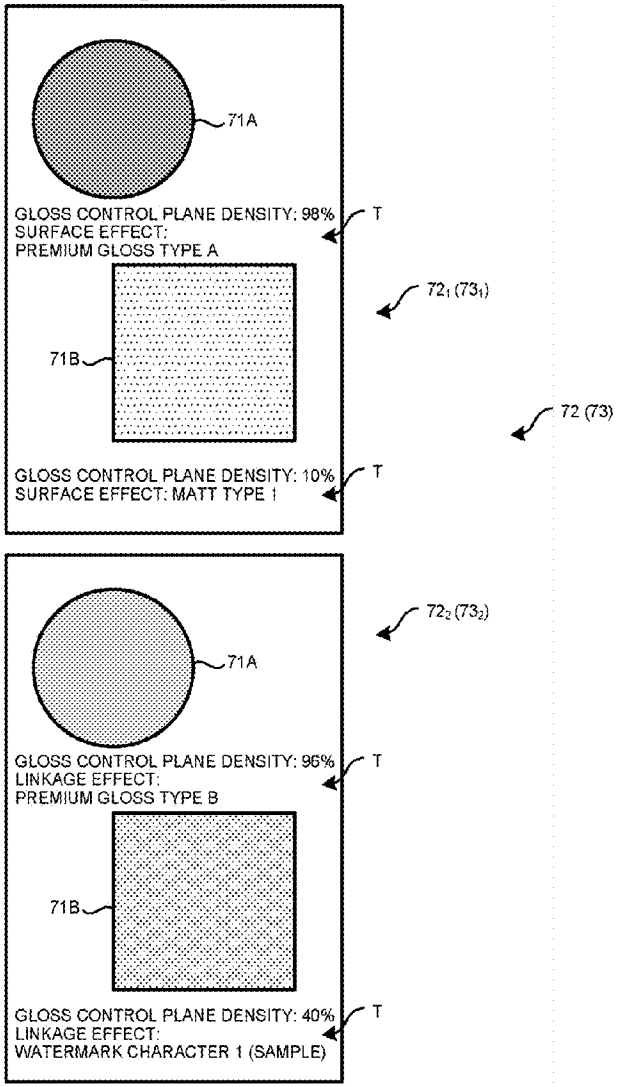

FIGS. 15A and 15B are descriptive views for explaining generation of the second gloss control plane data.

As illustrated in FIG. 15A, for example, it is assumed that surface effects are specified for a region 71A and a region 71B in first gloss control plane data 71. It is further assumed that a "premium gloss type A" is specified as the type of the surface effect for the region 71A and a "premium gloss type B" is read as the corresponding linkage effect. Furthermore, it is assumed that a "matt type 1" is specified as the type of the linkage effect for the region 71B and a "watermark character 1 (sample)" is read as the corresponding linkage effect.

In this case, the first generating unit 56P generates second gloss control plane data 73 so as to obtain a print result 72 as illustrated in FIG. 15B. Although the print result 72 actually includes color images based on the pieces of first color plane data, illustration thereof is omitted in FIG. 15B.

The first generating unit 56P generates, as the second gloss control plane data 73, a page (page $\mathbf{73}_1$ of the second gloss control plane data for obtaining a printed matter $\mathbf{72}_1$) in which the "premium gloss type A" is specified as the type of the surface effect for the region 71A and the "matt type 1" is specified as the type of the surface effect for the region 71B, and a page (page $\mathbf{73}_2$ of the second gloss control plane data for obtaining a printed matter $\mathbf{72}_2$) in which the "premium gloss type B" is specified as the linkage effect for the region 71A and the "watermark character 1 (sample)" is specified as the surface effect for the region 71B.

Thus, in this case, the first generating unit 56P generates the second gloss control plane data 73 such that the gloss regions specified in the first gloss control plane data 71 and the corresponding linkage regions are printed on different pages.

For example, the gloss regions of the surface effects specified in the first gloss control plane data 71 are printed on the printed matter $\mathbf{72}_1$ of a first page and the linkage regions of the linkage effects corresponding to the surface effects are printed on the printed matter $\mathbf{72}_2$ of a second page.

FIG. 15A illustrates the first gloss control plane data 71 of one page in total. When the first gloss control plane data 71 is configured by a plurality of pages, the first generating unit 56P only needs to generate the second gloss control plane data such that the gloss regions of the surface effects specified in a first page and a second page of the first gloss control plane data 71 are printed on a first page and a second page of the recording media, respectively. Furthermore, the first generating unit 56P generates the second gloss control plane data such that the linkage regions of the linkage effects corresponding to the surface effects specified in the first page of the first gloss control plane data 71 are printed on a third page of the recording medium and the linkage regions of the linkage effects corresponding to the surface effects specified in the second page of the first gloss control plane data 71 are printed on a fourth page of the recording medium.

In order to enable the surface effects and the linkage effects to be easily compared with each other, the first generating unit 56P may generate the second gloss control plane data such that the gloss regions of the surface effects specified in the first page of the first gloss control plane data 71 are printed on the first page of the recording medium, the linkage regions of the linkage effects corresponding to the surface effects specified in the first page of the first gloss control plane data 71 are printed on the second page of the recording medium, the gloss regions of the surface effects specified in the second page of the first gloss control plane data 71 are printed on the third page of the recording medium, and the linkage regions of the linkage effects corresponding to the surface effects specified in the second page of the first gloss control plane data 71 are printed on the fourth page of the recording medium.

When there are a plurality of linkage effects corresponding to each type of the surface effect specified in the first gloss control plane data, the first generating unit 56P only needs to generate the second gloss control plane data such that the respective linkage regions are printed on recording media by the number of pages in accordance with the number of corresponding linkage effects.

The first generating unit 56P preferably generates second color plane data by adding a color image expressing each piece of character information indicating the types of the surface effects and the density values of the corresponding gloss regions and pieces of character information indicating the linkage effect types and the density values of the corresponding linkage regions to positions corresponding to the gloss regions and the linkage regions.

That is to say, as illustrated in FIG. 15B, the first generating unit 56P preferably generates the second color plane data such that pieces of character information T expressing the types of the surface effects of the gloss regions or the linkage effect types of the linkage regions at adjacent positions are formed on the print result. This processing enables the user to easily grasp the types of the surface effects or the linkage effects that are applied to the respective regions formed on the recording media. Furthermore, the first generating unit 56P may cause the character information to further include the setting information of a print mode. The character information T is also the same in FIGS. 16 to 18D which will be described later.

Next, the case where the setting information received by the receiving unit 56M from the input unit 58 includes only the first setting is described. This case corresponds to the case where the user inputs identification information "2" in the print setting table as illustrated in FIG. 14. That is to say, among the first setting to the sixth setting, the On/Off information corresponding to the first setting is "On" and the pieces of On/Off information corresponding to other settings are "Off". It should be noted that the first setting is information indicating extraction of the overlapped region, as described above.

When the received setting information represents the first setting indicating the extraction of the first color plane data, the first generating unit 56P further generates the second color plane data formed by extracting overlapped regions overlapping with the gloss regions that are indicated by the first gloss control plane data from the color image specified in the first color plane data. The second color plane data preferably includes the above-mentioned pieces of character information T.

Figure 16A:
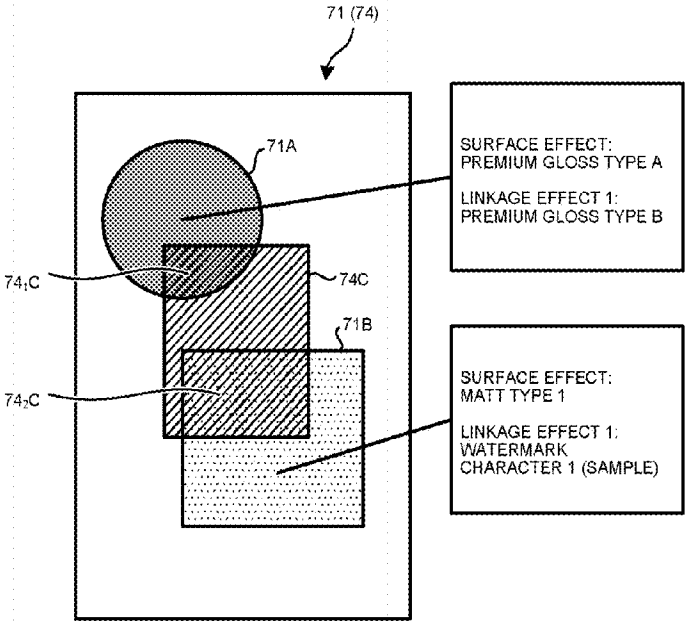
FIGS. 16A and 16B are descriptive views for explaining generation of the second gloss control plane data.
Figure 16B:
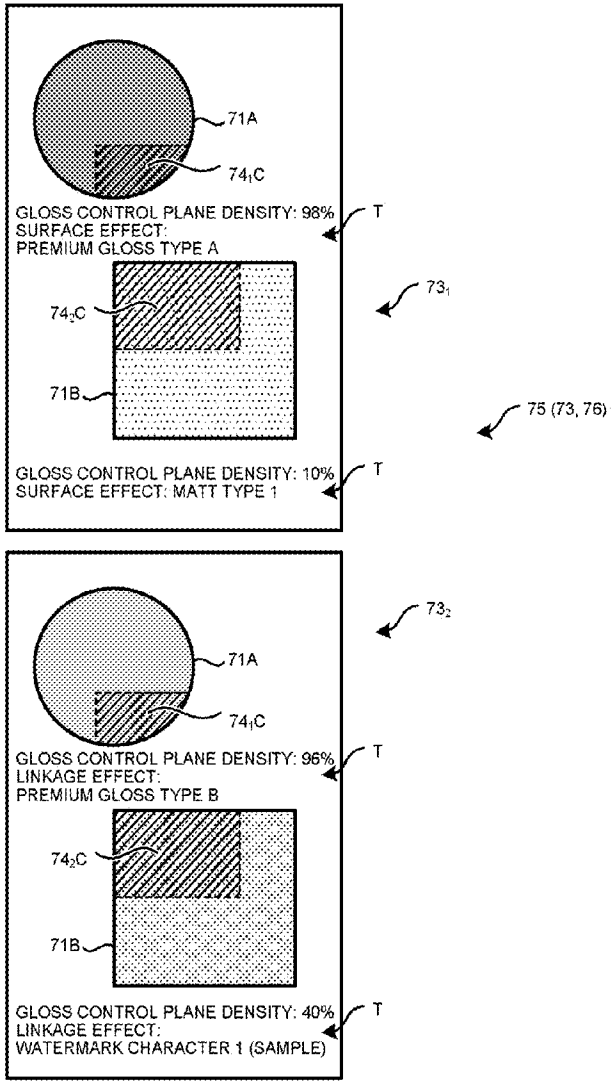

FIGS. 16A and 16B are descriptive views for explaining generation of the second gloss control plane data when the received setting information represents the first setting indicating the extraction of the first color plane data.

In the same manner as FIG. 15A, for example, it is assumed that the surface effects are specified for the region 71A and the region 71B in the first gloss control plane data 71 (see FIG. 16A). It is further assumed that the "premium gloss type A" is specified as the type of the surface effect for the region 71A and the "premium gloss type B" is read as the corresponding linkage effect. Furthermore, it is assumed that the "matt type 1" is specified as the type of the surface effect for the region 71B and the "watermark character 1 (sample)" is read as the corresponding linkage effect.

As illustrated in FIG. 16A, it is assumed that first color plane data 74 specifies a color image 74C for applying the color toners.

In this case, the first generating unit 56P generates the second color plane data formed by extracting overlapped regions $\mathbf{74}_1$C and $\mathbf{74}_2$C overlapping with the gloss regions (region 71A and region 71B) indicated by the first gloss control plane data 71 from the color image 74C specified in the first color plane data 74.

When the pieces of On/Off information corresponding to the settings (the second setting to the sixth setting) other than the first setting that are included in the received setting information are "Off", the first generating unit 56P generates the second gloss control plane data in the same manner as in the case where all the pieces of On/Off information corresponding to the first setting to the sixth setting are "Off".

When the received setting information represents the first setting, the first generating unit 56P generates the second gloss control plane data 73 and second color plane data 76 so as to obtain a print result 75 as illustrated in FIG. 16B. The second gloss control plane data 73 is the same as the second gloss control plane data 73 in FIG. 15B.

The second color plane data 76 is data formed by extracting the overlapped regions $\mathbf{74}_1$C and $\mathbf{74}_2$C overlapping with the gloss regions in the color image 74C specified in the first color plane data 74. The first generating unit 56P generates the second color plane data 76 of the number of pages that is the same as the number of pages of the second gloss control plane data 73.

Accordingly, a print result obtained by superimposing the color image as the above-mentioned overlapped regions specified in the second color plane data 76, the gloss regions specified in the second gloss control plane data 73, and the linkage regions corresponds to the print result 75 as illustrated in FIG. 16B.

The color image specified in the first color plane data includes a region that does not overlap with the gloss regions specified in the first gloss control plane data in some cases. When the surface effects are checked by the test printing, the region in the color image that does not overlap with the gloss regions is not particularly required to be printed. When the received setting information represents the first setting, the first generating unit 56P generates the second gloss control plane data 73 and the second color plane data 76 so as to obtain the print result 75 as illustrated in FIG. 16B.

Accordingly, a consumption amount of the colored colorants such as the color toners can be reduced.

Next, the case where the setting information received by the receiving unit 56M from the input unit 58 only includes the second setting is described. This case corresponds to the case where the user inputs identification information "3" in the print setting table as illustrated in FIG. 14. That is to say, among the first setting to the sixth setting, the On/Off information corresponding to the second setting (printing speed) is "On" and the pieces of On/Off information corresponding to the other settings are "Off". It should be noted that the second setting is information indicating the printing speed as described above and indicates both of the speed priority and the image quality priority when the On/Off information corresponding to the second setting is "On".

When the second setting represented by the received setting information indicates both of the image quality priority and the speed priority (the corresponding On/Off information is "On"), the first generating unit 56P generates the second gloss control plane data including third gloss control plane data as the image priority and fourth gloss control plane data as the speed priority.

The third gloss control plane data is gloss control plane data as the image quality priority that specifies the types of the surface effects and the gloss regions specified in the first gloss control plane data, and the read linkage effect types corresponding to the types of the surface effects and the linkage regions. The first generating unit 56P does not perform total amount restriction processing when it generates the third gloss control plane data.

The fourth gloss control plane data is gloss control plane data as the speed priority that specifies the types of the surface effects and the gloss regions specified in the first gloss control plane data, and the read linkage effect types corresponding to the types of the surface effects and the linkage regions. Furthermore, in the fourth gloss control plane data, the density values are adjusted such that the total amount of colorants to be applied to each pixel is equal to or smaller than a total amount restriction value.

Figures 17A, 17B, 17C:
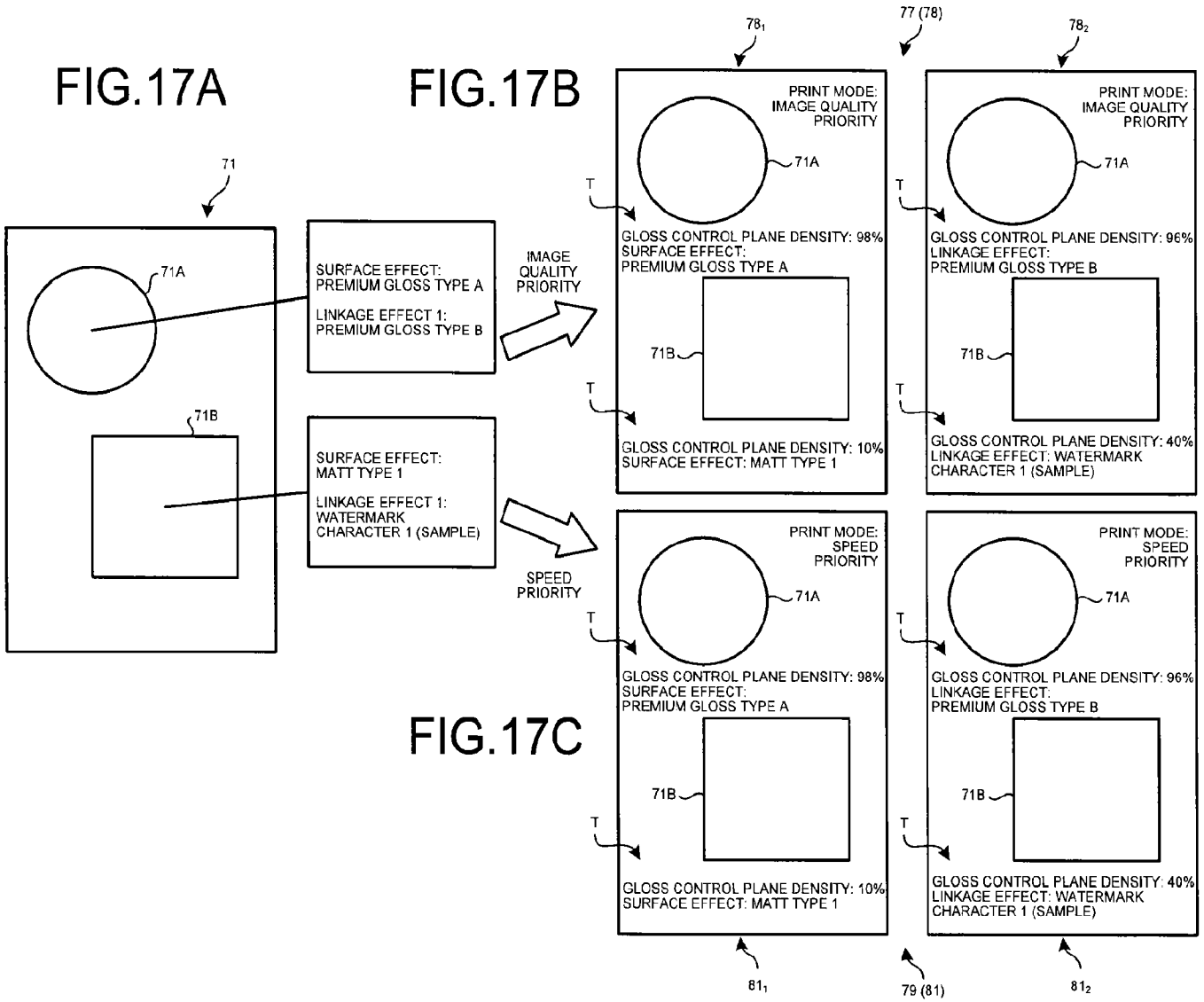
FIGS. 17A to 17C are descriptive views for explaining generation of the second gloss control plane data.

FIGS. 17A to 17C are descriptive views for explaining generation of the second gloss control plane data when the second setting represented by the received setting information indicates both of the image quality priority and the speed priority.

In the same manner as FIG. 15A, for example, it is assumed that the surface effects are specified for the region 71A and the region 71B in first gloss control plane data 71 (see FIG. 17A). It is further assumed that the "premium gloss type A" is specified as the type of the surface effect for the region 71A and the "premium gloss type B" is read as the corresponding linkage effect. Furthermore, it is assumed that the "matt type 1" is specified as the type of the surface effect for the region 71B and the "watermark character 1 (sample)" is read as the corresponding linkage effect.

In this case, the first generating unit 56P generates, as the second gloss control plane data, third gloss control plane data 78 obtaining a print result 77 as illustrated in FIG. 17B and fourth gloss control plane data 81 obtaining a print result 79 as illustrated in FIG. 17B. Although the print result 77 and the print result 79 actually include color images based on the first color plane data, illustration thereof is omitted in FIG. 17B and FIG. 17C.

To be specific, the first generating unit 56P generates, as the third gloss control plane data 78, a page $\mathbf{78}_1$ specifying the "premium gloss type A" as the surface effect for the region 71A and specifying the "matt type 1" as the surface effect for the region 71B, and a page $\mathbf{78}_2$ specifying the "premium gloss type B" as the linkage effect for the region 71A and specifying the "watermark character 1 (sample)" as the linkage effect for the region 71B (see FIG. 17B). In this case, the first generating unit 56P generates the third gloss control plane data without performing the above-mentioned total amount restriction processing.

The first generating unit 56P generates, as the fourth gloss control plane data 81, a page $\mathbf{81}_1$ specifying the "premium gloss type A" as the surface effect for the region 71A and specifying the "matt type 1" as the surface effect for the region 71B, and a page $\mathbf{81}_2$ specifying the "premium gloss type B" as the linkage effect for the region 71A and specifying the "watermark character 1 (sample)" as the linkage effect for the region 71B (see FIG. 17C). In this case, the first generating unit 56P generates the fourth gloss control plane data by performing the above-mentioned total amount restriction processing.

The first generating unit 56P generates the third gloss control plane data and the fourth gloss control plane data as the second gloss control plane data.

The user can easily check the gloss regions and the linkage regions formed in each of two print modes of the image quality priority and the speed priority by one-time test printing so as to use them for determining the print mode to be employed in the normal printing.

In this case, the first generating unit 56P preferably generates the second color plane data by adding a color image expressing each piece of character information indicating the types of the surface effects, the density values, and the print modes of the corresponding gloss regions, and pieces of character information indicating the linkage effect types, the density values, and the print modes of the corresponding linkage regions to positions corresponding to the gloss regions and the linkage regions.

The printing of the pieces of character information enables the user to easily check the print mode in which the print result has been formed.

Next, the case where the setting information received by the receiving unit 56M from the input unit 58 represents the third setting is described. This case corresponds to the case where the On/Off information corresponding to the third setting (designation of the number of recording media) is "On".

As described above, the third setting indicates that the gloss regions and the linkage regions are printed on the set number of recording media. Hereinafter, in order to simplify the description, it is assumed that the set number of recording media in the third setting is one. The number of recording media set in the third setting only needs to be N (N is an integer of equal to larger than 1) and it is not limited to one.

When the received setting information represents the third setting, the first generating unit 56P generates the second gloss control plane data in which the gloss regions specified in the respective pages included in the first gloss control plane data and the corresponding linkage regions are arranged on the number of pages set in the third setting.

A method of arranging the gloss regions and the linkage regions on the number of pages set in the third setting is not limited and various methods are exemplified. In the embodiment, methods of three types including the fourth setting to the sixth setting are described, as an example.

First, the case where the setting information received by the receiving unit 56M from the input unit 58 represents the third setting and the fourth setting will be described. This case corresponds to the case where the user inputs the identification information "4-1" in the print setting table as illustrated in FIG. 14. That is to say, among the first setting to the sixth setting, the pieces of On/Off information corresponding to the third setting (designation of the number of recording media) and the fourth setting (arrangement change) are On and the pieces of On/Off information corresponding to the other settings are "Off".

As described above, the fourth setting indicates rearrangement of the gloss regions of the types of the surface effects specified in the first gloss control plane data and the linkage regions of the linkage effects corresponding to the types of the surface effects within one page (the number of recording media set in the third setting).

When the received setting information includes the third setting and the fourth setting, the first generating unit 56P generates the second gloss control plane data in which the gloss regions specified in the respective pages included in the first gloss control plane data and the read linkage regions corresponding to the gloss regions are rearranged within one page (the number of recording media set in the third setting).

The case where the setting information represents the third setting and the fifth setting will also be described. This case corresponds to the case where the user inputs identification information "4-2" in the print setting table as illustrated in FIG. 14. That is to say, among the first setting to the sixth setting, the pieces of On/Off information corresponding to the third setting (designation of the number of recording media) and the fifth setting (aggregation) are "On" and the pieces of On/Off information corresponding to the other settings are "Off".

It should be noted that the fifth setting indicates the aggregation of the gloss regions of the types of the surface effects specified in the first gloss control plane data formed by a plurality of pages and the linkage regions of the linkage effect types corresponding to the types of the surface effects into one page (the number of recording media set in the third setting).

When the received setting information represents the third setting and the fifth setting, the first generating unit 56P generates the second gloss control plane data in which the gloss regions specified in the respective pages included in the first gloss control plane data and the linkage regions corresponding to the gloss regions are aggregated and arranged in one page while maintaining relative positions of the gloss regions in the respective pages of the second gloss control plane data.

The case where the received setting information represents the third setting and the sixth setting will also be described. This case corresponds to the case where the user inputs identification information "4-3" in the print setting table as illustrated in FIG. 14. That is to say, among the first setting to the sixth setting, the pieces of On/Off information corresponding to the third setting (designation of the number of recording media) and the sixth setting are On and the pieces of On/Off information corresponding to the other settings are "Off".

It should be noted that the sixth setting indicates arrangement of each of the gloss regions and the linkage regions so as to have a predetermined shape.

When the received setting information represents the third setting and the sixth setting, the first generating unit 56P generates the second gloss control plane data in which the gloss regions specified in the respective pages included in the first gloss control plane data and the read linkage regions corresponding to the gloss regions are arranged within one page (the number of recording media set in the third setting) so as to have a shape specified in the sixth setting.

Figure 18A:
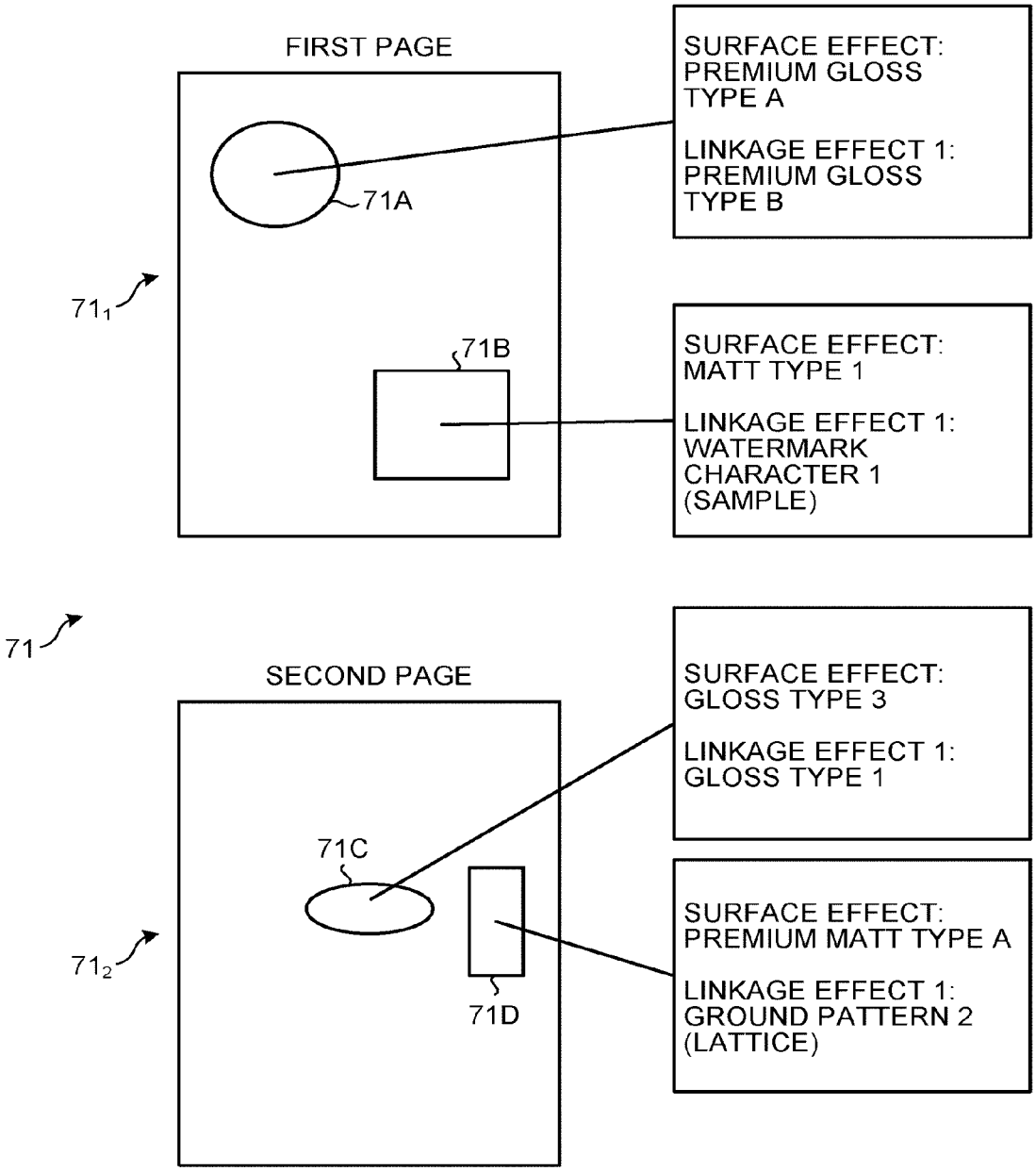
FIG. 18A is a descriptive view for explaining generation of the second gloss control plane data.

FIG. 18A to FIG. 18D are descriptive views for explaining generation of the second gloss control plane data when the received setting information represents the third setting and any one of the sixth setting, the fourth setting, and the fifth setting, respectively For example, it is assumed that the surface effects are specified for the region 71A and the region 71B in a first page $\mathbf{71}_1$ of the first gloss control plane data 71 (see FIG. 18A). It is further assumed that the "premium gloss type A" is specified as the type of the surface effect for the region 71A and the "premium gloss type B" is read as the corresponding linkage effect. Furthermore, it is assumed that the "matt type 1" is specified as the type of the surface effect for the region 71B and the "watermark character 1 (sample)" is read as the corresponding linkage effect.

In addition, it is assumed that the surface effects are specified for a region 71C and a region 71D in a second page $\mathbf{71}_2$ of the first gloss control plane data 71 (see FIG. 18A). It is further assumed that a "gloss type 3" is specified as the type of the surface effect for the region 71C and a "gloss type 1" is read as the corresponding linkage effect. Furthermore, it is assumed that the "premium gloss type A" is specified as the type of the surface effect for the region 71D and a "ground pattern 2 (lattice)" is read as the corresponding linkage effect.

Figure 18B:
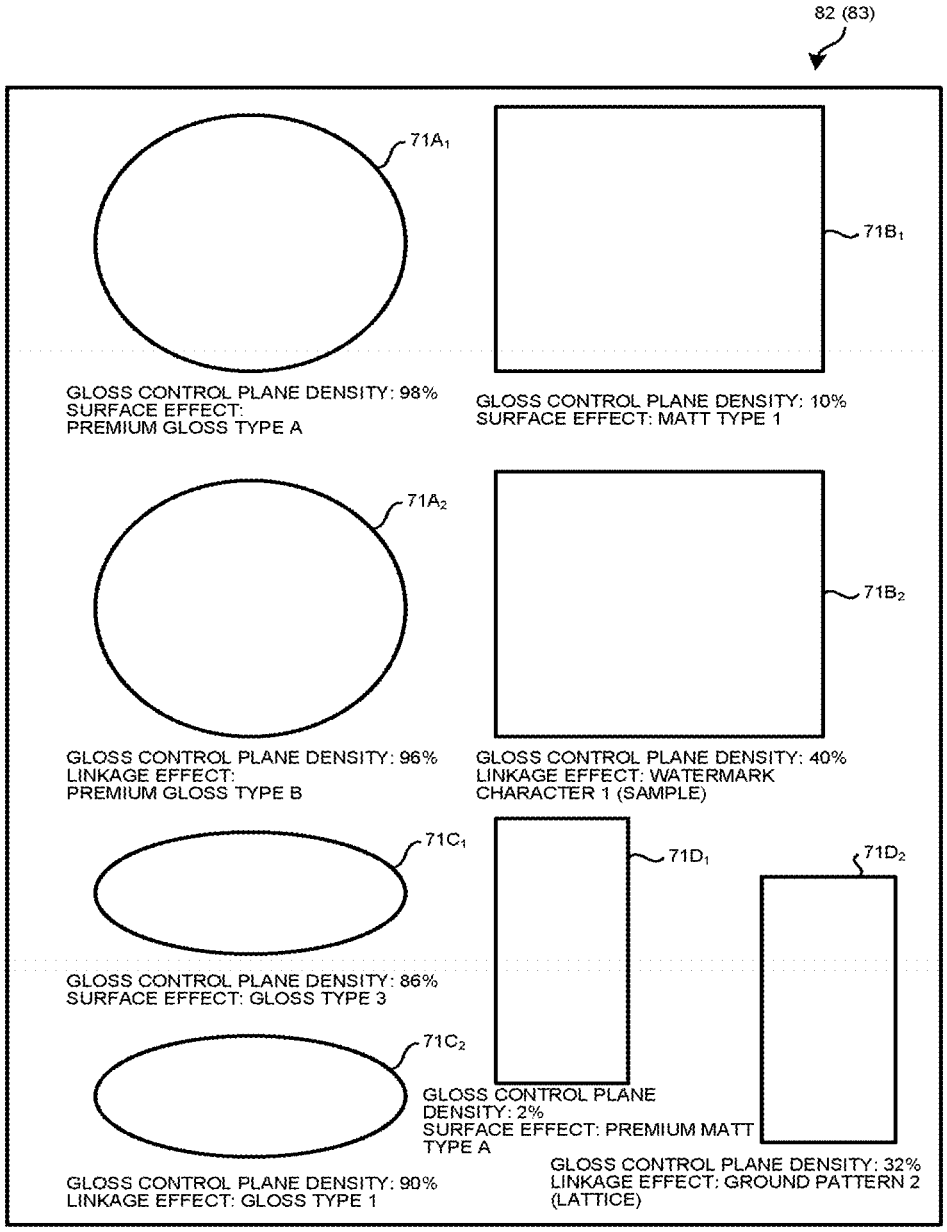
FIG. 18B is a descriptive view for explaining generation of the second gloss control plane data.
Figure 18C:
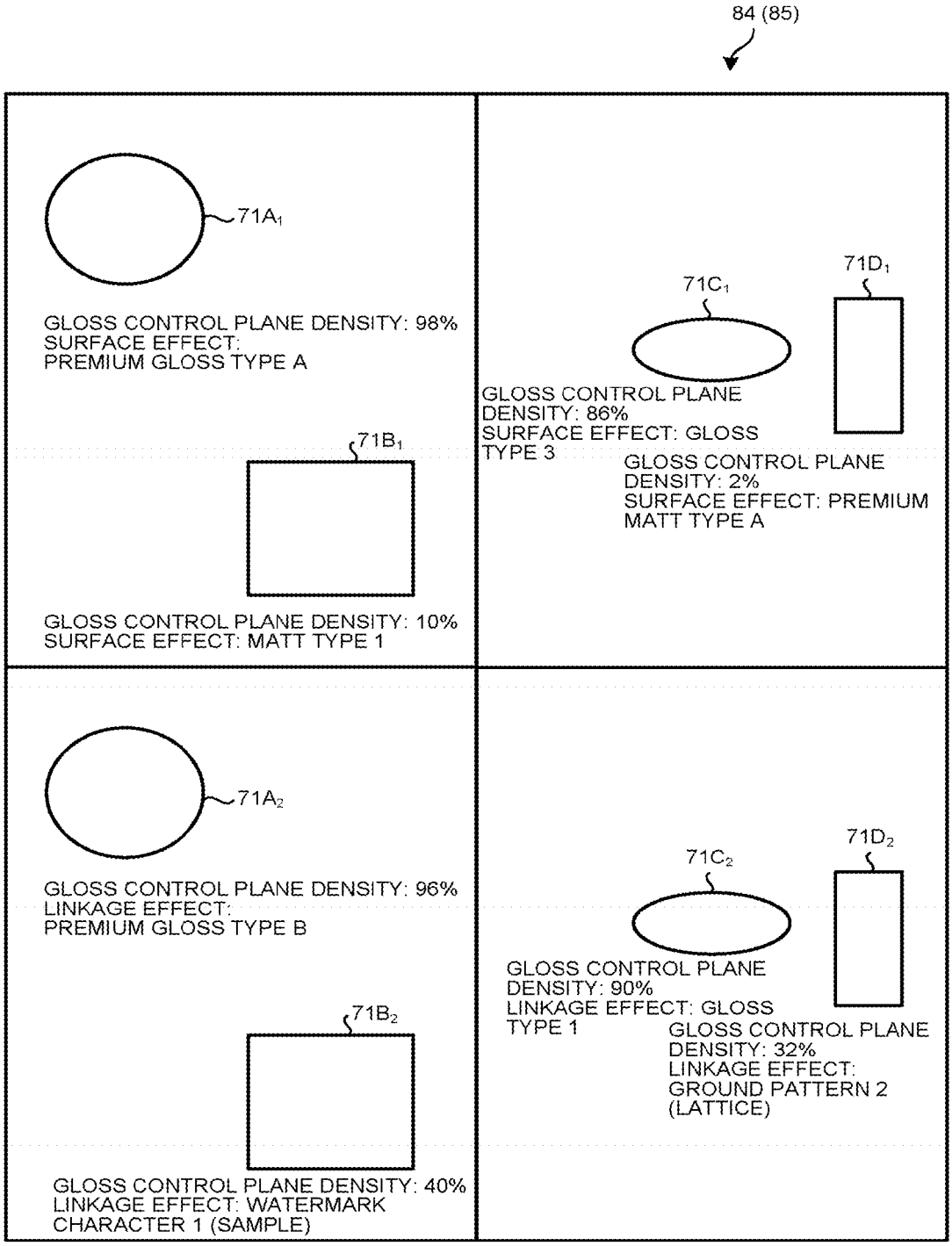
FIG. 18C is a descriptive view for explaining generation of the second gloss control plane data.
Figure 18D:
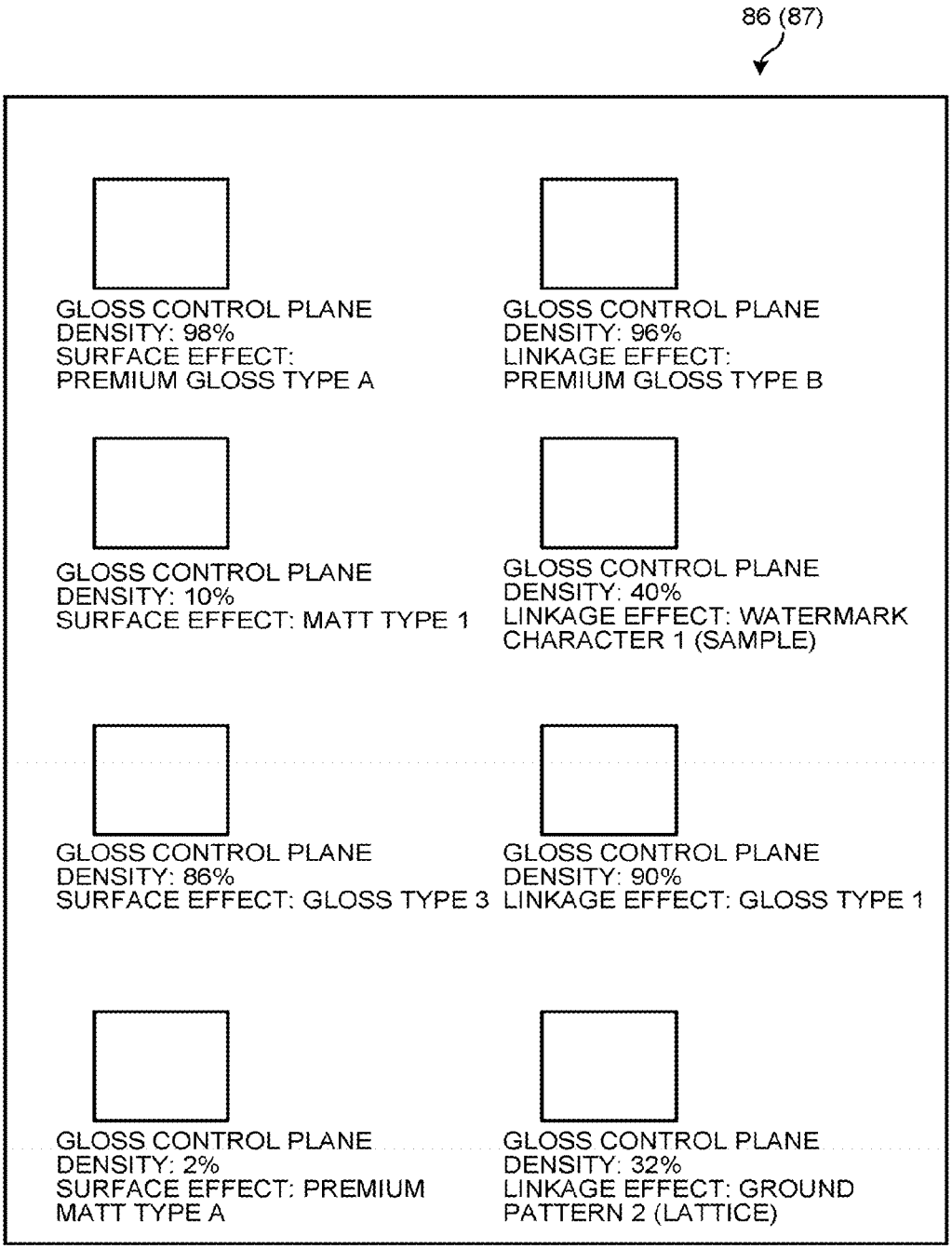
FIG. 18D is a descriptive view for explaining generation of the second gloss control plane data.

In this case, the first generating unit 56P generates second gloss control plane data 83, 85, or 87 obtaining a print result 82, 84, or 86 that is illustrated in FIG. 18B, FIG. 18C, or FIG. 18D, respectively.

Specifically, when the received setting information represents the third setting and the fourth setting, the first generating unit 56P generates the second gloss control plane data 83 obtaining the print result 82 as illustrated in FIG. 18B. Although the print result 82 actually includes a color image based on the first color plane data, illustration thereof is omitted in FIG. 18B.

To be specific, the first generating unit 56P generates, as the second gloss control plane data 83, the second gloss control plane data including a region 71$A_1$, a region 71$A_2$, a region 71$B_1$, a region 71$B_2$, a region 71$C_1$, a region 71$C_2$, a region 71$D_1$, and a region 71$D_2$ within the number of recording media set in the third setting (in the embodiment, within one page as an example).

The region 71$A_1$ is a region for which the "premium gloss type A" is specified as the surface effect. The region 71$A_2$ is a region for which the "premium gloss type B" is specified as the linkage effect of the type of the surface effect. The region 71$B_1$ is a region for which the "matt type 1" is specified as the surface effect. The region 71$B_2$ is a region for which the "watermark character 1 (sample)" is specified as the linkage effect of the type of the surface effect. The region 71$C_1$ is a region for which the "gloss type 3" is specified as the surface effect. The region 71$C_2$ is a region for which the "gloss type 1" is specified as the linkage effect of the type of the surface effect. The region 71$D_1$ is a region for which the "premium matt type A" is specified as the surface effect. The region 71$D_2$ is a region for which the "ground pattern 2 (lattice)" is specified as the linkage effect of the type of the surface effect.

Thus, the gloss regions specified in the respective pages of the first gloss control plane data 71 are extracted and are rearranged within one page of the second gloss control plane data 83 while maintaining the shapes and the sizes of the gloss regions specified in the first gloss control plane data 71, and the linkage regions corresponding to the types of the surface effects of the extracted gloss regions are arranged in the same page of the second gloss control plane data 83 so as to have the shapes and the sizes of the corresponding gloss regions. With this arrangement, the first generating unit 56P generates the second gloss control plane data 83.

On the other hand, when the received setting information represents the third setting and the fifth setting, the first generating unit 56P generates the second gloss control plane data 85 obtaining the print result 84 as illustrated in FIG. 18C. Although the print result 84 actually includes a color image based on the first color plane data, illustration thereof is omitted in FIG. 18C.

To be specific, the first generating unit 56P generates the second gloss control plane data 85 in which the gloss regions specified in the respective pages included in the first gloss control plane data 71 (71$_1$ to 71$_2$) (see FIG. 18A) formed by a plurality of pages and the read linkage regions corresponding to the gloss regions are aggregated and arranged in the number of pages set in the third setting (in the embodiment, one page, as an example) while maintaining the relative positions of the gloss regions in the respective pages of the second gloss control plane data.

In other words, the first generating unit 56P arranges the gloss regions specified in the respective pages included in the first gloss control plane data 71$_1$ to 71$_2$ (71) (see FIG. 18A) formed by the plurality of pages and the read linkage regions corresponding to the gloss regions on the different pages, and further aggregates and arranges them in the set number of pages.

Thus, the first generating unit 56P generates the second gloss control plane data 85 (see FIG. 18C) in which the respective pages in which the gloss regions are specified and the respective pages in which the corresponding linkage regions are specified are aggregated in one page while maintaining the relative positions of the gloss regions indicated in the respective pages of the first gloss control plane data 71 in the respective pages.

In this case, the first generating unit 56P can generate the second gloss control plane data 85 in which the gloss regions are aggregated in the specified number of recording media while maintaining the relative positions of the gloss regions in the respective pages of the first gloss control plane data 71. With this aggregation, the user can check other surface effects easily while checking an arrangement relation among the gloss regions specified in the first gloss control plane data 71.

When the received setting information represents the third setting and the sixth setting, the first generating unit 56P generates the second gloss control plane data 87 obtaining the print result 86 as illustrated in FIG. 18D. Although the print result 86 actually includes a color image based on the first color plane data, illustration thereof is omitted in FIG. 18D.

To be specific, the first generating unit 56P generates the second gloss control plane data 87 in which the gloss regions specified in the respective pages included in the first gloss control plane data 71 and the read linkage regions corresponding to the gloss regions are arranged within the number of pages set in the third setting (in the embodiment, one page, as an example) so as to have predetermined shapes previously set in the sixth setting in one page. In order to arrange them so as to have the predetermined shapes, for example, the first generating unit 56P only needs to extract regions having the predetermined shapes (for example, rectangular shapes and circular shapes) from the respective corresponding regions (gloss regions and linkage regions).

In the example as illustrated in FIG. 18D, the first generating unit 56P generates the second gloss control plane data 87 in which the gloss regions of the types of the surface effects specified in the first control plane data 71 and the linkage regions as the linkage effects corresponding to the types of the surface effects are deformed into predetermined shapes (for example, rectangular shapes) and aligned as the second gloss control plane data 87.

Accordingly, even when surface regions to which the surface effects of a large number of types are applied are specified in the first gloss control plane data and a large number of linkage regions are read, the second gloss control plane data can be generated such that they are arranged within the specified number of pages.

Referring back to FIG. 10, the second generating unit 56G generates the special color colorant plane data that is used by the execution unit (printing apparatus 30) applying the special color colorant to the recording medium from the second gloss control plane data generated by the first generating unit 56P when the determination unit 56B has determined that the type information indicates the test printing.

The special color colorant plane data specifies the specification contents corresponding to the density values in the second gloss control plane data for the respective pixels. The second generating unit 56G determines the On/Off information of the glosser 80 and the specification contents of the special color colorant plane data that correspond to each of the first density values (surface effect density values) and the second density values (linkage effect density values) specified in the second gloss control plane data based on the surface effect selection table stored in the storage unit 56D.

Then, the second generating unit 56G determines On or Off of the glosser 80 and appropriately generates the inverse mask, the solid mask, or the like using the pieces of first color plane data of 8 bits of CMYK on which the gamma correction has been performed based on the determination results so as to generate the special color colorant plane data of 2 bits for causing the special color toner to adhere. In this case, the second generating unit 56G appropriately generates the special color colorant plane data (clear toner plane 1) that is used in the printer 70 and the special color colorant plane data (clear toner plane 2) that is used in the low-temperature fixing device 90 in accordance with the specification contents of the special color colorant plane data corresponding to each of the first density values and the second density values of the second gloss control plane data for the respective pixels in the surface effect selection table.

The second generating unit 56G outputs the generated special color colorant plane data of 2 bits and the determined On/Off information indicating On or Off of the glosser 80 to the si3 unit 57.

The switching controller 56E receives timing information indicating a switching timing of print modes from the first generating unit 56P. When the second setting that is represented by the setting information received by the receiving unit 56M indicates both of the image quality priority and the speed priority, the first generating unit 56P generates the timing information for changing the print mode between the image formation based on the third gloss control plane data as the image quality priority and image formation based on the fourth gloss control plane data as the speed priority. Then, the first generating unit 56P transmits the total amount restriction value and the timing information to the switching controller 56E.

The switching controller 56E outputs the total amount restriction value to the TRC 53 and sets an engine speed of the printing apparatus 30 in accordance with the timing indicated by the timing information thus received. To be specific, the switching controller 56E controls the printing apparatus 30 so as to execute printing in an image quality priority mode where a larger amount of toners (colorants) can be made to adhere by lowering the engine speed in the image formation based on the third gloss control plane data as the image quality priority. The switching controller 56E controls the printing apparatus 30 so as to execute printing in a speed priority mode where productivity has priority without lowering the engine speed in the image formation based on the fourth gloss control plane data as the speed priority.

The printing apparatus 30 can therefore obtain the above-mentioned print result 72, 75, 77, 79, 82, 84, or 86 (see FIG. 15 to FIG. 17, FIG. 18B to FIG. 18D) in accordance with the setting information.

Figure 19:
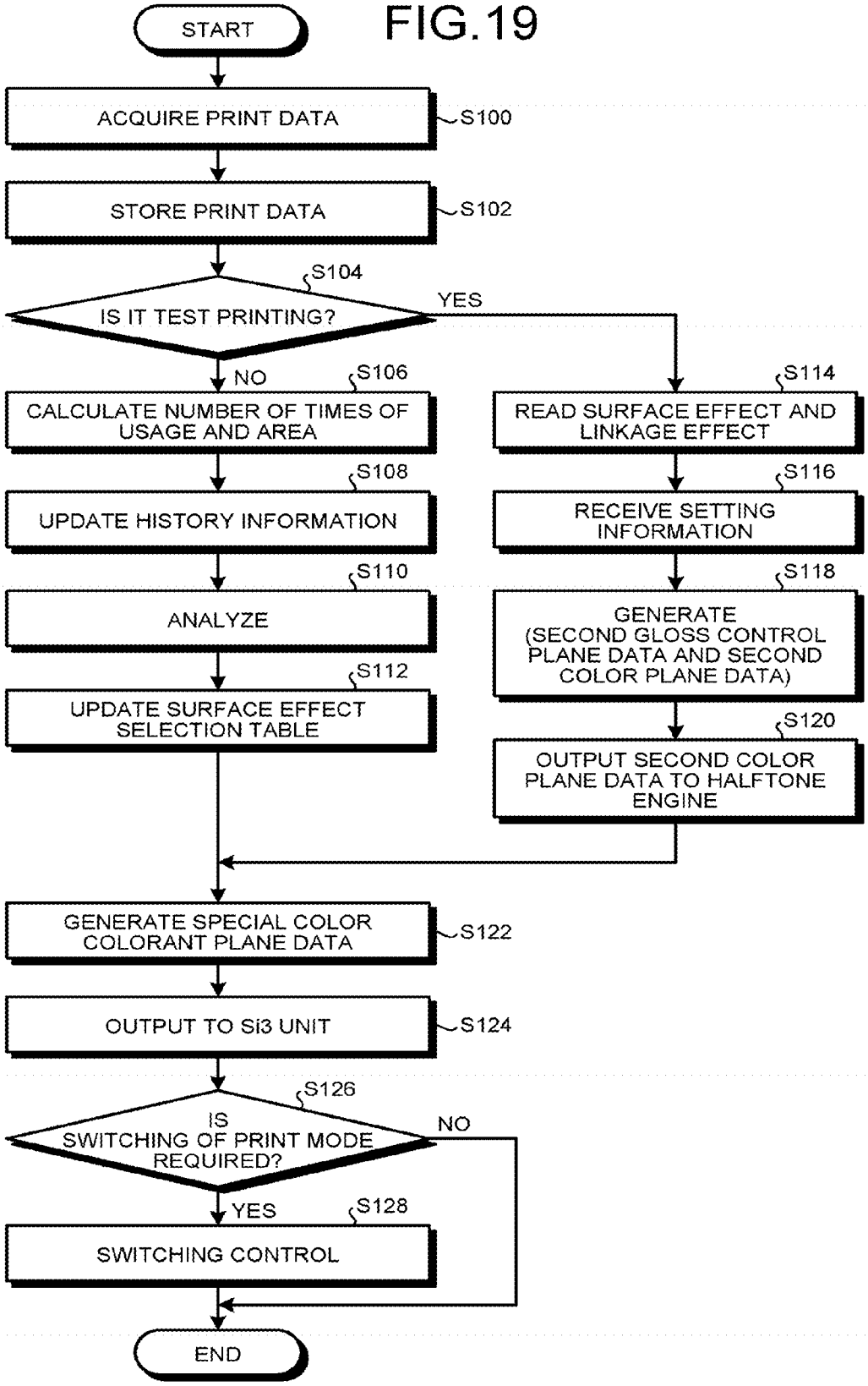
FIG. 19 is a flowchart illustrating procedures of image processing.

Next, procedures of the image processing that is executed by the clear processing 56 of the DFE 50 in the embodiment will be described. FIG. 19 is a flowchart illustrating the procedures of the image processing.

First, the acquisition unit 56A acquires the print data including the type information, the first gloss control plane data, and the pieces of first color plane data (step S100). Then, the acquisition unit 56A stores the acquired print data in the storage unit 56D (step S102).

Subsequently, the determination unit 56B determines whether the type information acquired at step S100 indicates the normal printing or the test printing (step S104).

When the type information has been determined to indicate the normal printing (No at step S104), the process proceeds to step S106. At step S106, the calculation unit 56H calculates the analysis information in the first gloss control plane data acquired at step S100. In the embodiment, the calculation unit 56H calculates, as the analysis information, the numbers of times of usage of the types of the surface effects in the first gloss control plane data and the areas of the gloss regions corresponding to the types of the surface effects in the first gloss control plane data (step S106).

Then, the first updating unit 56I updates the history information stored in the storage unit 56D using the calculation results of the numbers of times of usage of the respective types of the surface effects and the areas of the gloss regions that have been calculated at step S106 (step S108).

Subsequently, the second updating unit 56J analyzes the history information updated at step S108 (step S110) and selects the linkage effect types corresponding to the respective types of the surface effects and registers them in the surface effect selection table based on the analysis results so as to update the surface effect selection table (step S112). Then, the process proceeds to step S122, which will be described later.

On the other hand, when the type information has been determined to indicate the test printing at step S104 (Yes at step S104), the process proceeds to step S114.

At step S114, the reading unit 56K reads the types of the surface effects corresponding to the density values specified in the first gloss control plane data acquired at step S100 and the linkage effect types corresponding to the density values from the surface effect selection table (step S114).

Thereafter, the receiving unit 56M receives designation of the setting information indicating the print setting of each of the gloss regions to which the surface effects are applied and the linkage regions to which the linkage effects are applied to the recording medium (step S116).

Then, the first generating unit 56P generates the second gloss control plane data in accordance with the setting information received at step S116 (step S118). Furthermore, the first generating unit 56P generates the second color plane data from the first color plane data in accordance with the setting information received at step S116.

When the first generating unit 56P generates the second color plane data at step S118, it outputs it to the halftone engine 55 (see FIG. 8) (step S120). Then, the process proceeds to step S122.

At step S122, the second generating unit 56G generates the special color colorant plane data. When the type information has been determined to indicate the normal printing at step S104, the second generating unit 56G generates the special color colorant plane data using the first gloss control plane data acquired at step S100. On the other hand, when the type information has been determined to indicate the test printing at step S104, the second generating unit 56G generates the special color colorant plane data using the second control plane data generated at step S118.

After that, the second generating unit 56G outputs the generated special color colorant plane data to the si3 unit 57 (step S124).

Then, the switching controller 56E determines whether switching of the print mode is required (step S126). The switching controller 56E determines whether the second setting represented by the setting information received by the receiving unit 56M at step S116 indicates both of the image quality priority and the speed priority so as to make a determination at step S126. The case where the second setting indicates both of the image quality priority and the speed priority corresponds to the case where the On/Off information corresponding to the second setting is "On".

When the switching is not required (No at step S126), this routine is finished. When the switching is required (Yes at step S126), the process proceeds to step S128.

At step S128, the switching controller 56E outputs the total amount restriction value to the TRC 53 and sets the engine speed of the printing apparatus 30 in accordance with the timing indicated by the timing information received from the first generating unit 56P (step S128). Then, this routine is finished.

As described above, the DFE 50 in the embodiment includes the storage unit 56D, the acquisition unit 56A, the determination unit 56B, the reading unit 56K, the first generating unit 56P, and the second generating unit 56G. The storage unit 56D previously stores therein the surface effect selection table in which the density values indicating the surface effects as the visual or tactile effects on the recording medium, the types of the surface effects, and the types of the linkage effects as other surface effects related to the types of the surface effects are associated with one another. The acquisition unit 56A acquires the print data including the type information indicating the normal printing or the test printing, the first gloss control plane data specifying the density values for specifying the types of the surface effects and the gloss regions to which the surface effects are applied, and the pieces of first color plane data of the color image. The determination unit 56B determines whether the type information indicates the normal printing or the test printing. When the type information has been determined to indicate the test printing, the reading unit 56K reads the types of the surface effects and the linkage effect types that correspond to the density values specified in the first gloss control plane data from the surface effect selection table. The first generating unit 56P generates the second gloss control plane data specifying the types of the surface effects and the gloss regions specified in the first gloss control plane data and the read linkage effect types corresponding to the types of the surface effects and the linkage regions to which the linkage effects are applied. The second generating unit 56G generates the special color colorant plane data that is used by the execution unit (printing apparatus 30) applying the special color colorant to the recording medium from the second gloss control plane data.

The printing apparatus 30 applies the special color colorant (in the embodiment, the clear toner) to the recording medium based on the second gloss control plane data so as to form the linkage regions of the linkage effects as other surface effects related to the surface effects in addition to the gloss regions of the surface effects specified in the first gloss control plane data on the recording medium.

Accordingly, the DFE 50 in the embodiment enables the user to easily check the surface effects of the types other than the types specified in the print data (to be specific, first gloss control plane data).

First Variation

In the above-mentioned first embodiment, the DFE 50 and the printing apparatus 30 are configured as separate bodies. Alternatively, the DFE 50 and the respective devices (at least one of the printer 70, the glosser 80, and the low-temperature fixing device 90) configuring the printing apparatus 30 may be configured integrally.

Figure 20:
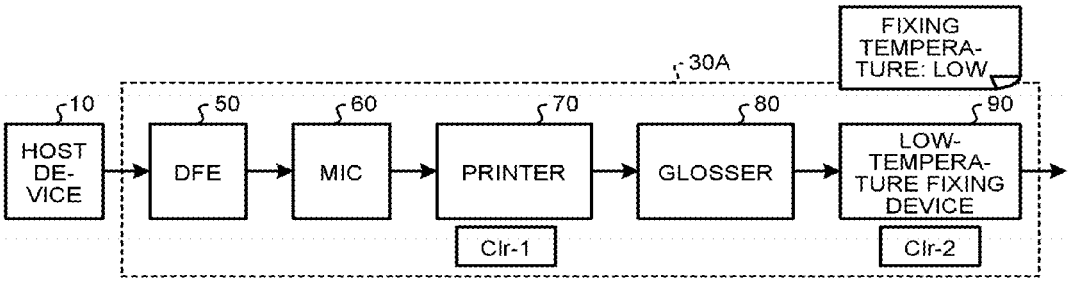
FIG. 20 is a schematic diagram illustrating an example of an image processing system.

FIG. 20 is a plan view schematically illustrating an example of an image processing system in a variation. The image processing system is configured by including the host device 10 and a multifunctional peripheral 30A. The host device 10 and the multifunctional peripheral 30A are connected so as to transmit and receive signals and pieces of data to and from each other. The multifunctional peripheral 30A includes the DFE 50, the MIC 60, the printer 70, the glosser 80, and the low-temperature fixing device 90.

The configurations of the host device 10, the DFE 50, the MIC 60, and the printer 70 are the same as those in the first embodiment.

Thus, the DFE 50 and at least one of the printer 70, the glosser 80, and the low-temperature fixing device 90 may be integrally configured.

Second Embodiment

Any of the pieces of processing that are performed by one device in the first embodiment may be configured to be performed by equal to or more than one other device(s) connected to the one device through a network.

As an example of this configuration, in an image processing system in the embodiment, a part of the functions of the DFE is implemented on a server device on a network.

Figure 21:
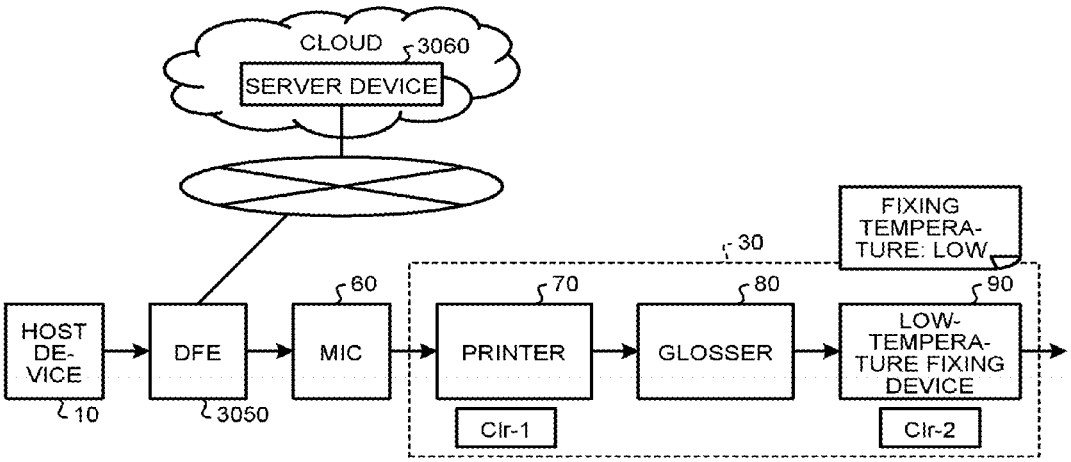
FIG. 21 is a diagram illustrating an example of the configuration of an image processing system.

FIG. 21 is a diagram illustrating an example of the configuration of the image processing system in the embodiment. As illustrated in FIG. 21, the image processing system in the embodiment includes the host device 10, a DFE 3050, the MIC 60, the printing apparatus 30 (the printer 70, the glosser 80, the low-temperature fixing device 90), and a server device 3060 on a cloud. The host device 10, the MIC 60, and the printing apparatus 30 are the same as those in the first embodiment.

In the embodiment, the DFE 3050 is configured to be connected to the server device 3060 through a network such as the Internet. In the embodiment, the acquisition unit 56A, the determination unit 56B, the analysis unit 56C, the storage unit 56D, the switching controller 56E, the reading unit 56K, the receiving unit 56M, the first generating unit 56P, and the second generating unit 56G of the DFE 50 in the first embodiment are provided on the server device 3060.

That is to say, to be specific, in the embodiment, the DFE 3050 is connected to the single server device 3060 through the network (cloud) such as the Internet and the server device 3060 generates the special color colorant plane data.

Figure 22:
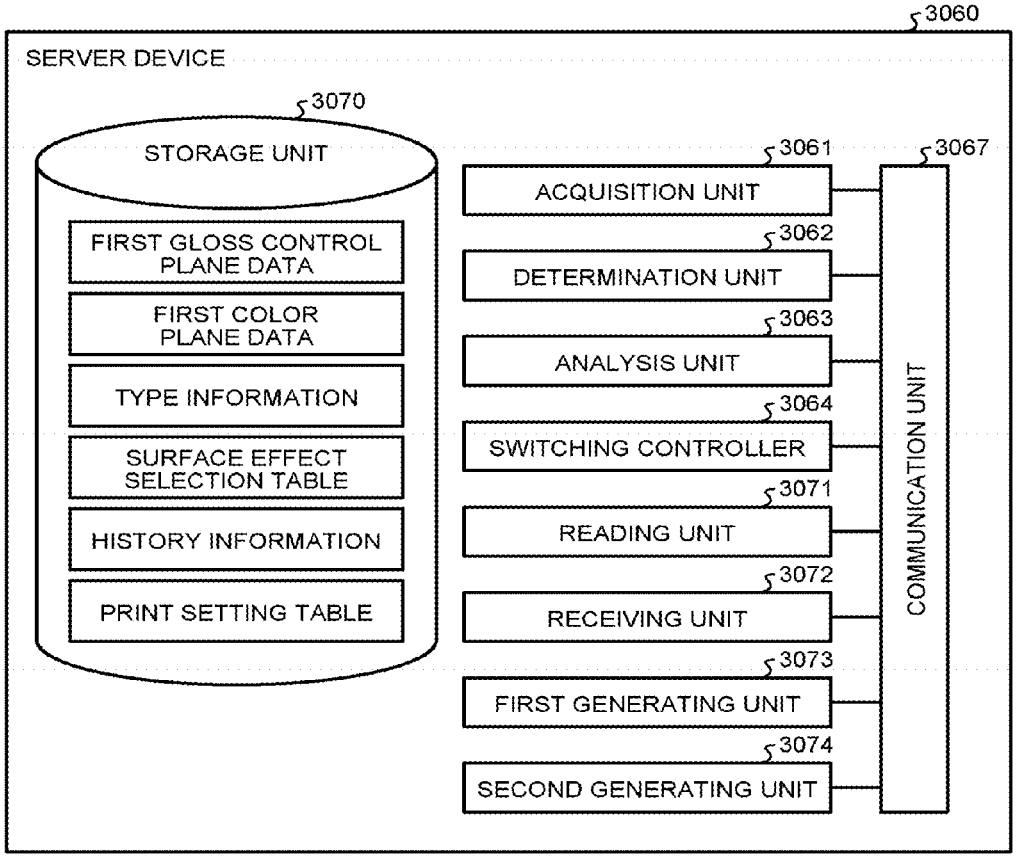
FIG. 22 is a block diagram illustrating the functional configuration of a server device.

First, the server device 3060 is described. FIG. 22 is a block diagram illustrating the functional configuration of the server device 3060 in the embodiment. The server device 3060 includes a storage unit 3070, an acquisition unit 3061, a determination unit 3062, an analysis unit 3063, a switching controller 3064, a reading unit 3071, a receiving unit 3072, a first generating unit 3073, a second generating unit 3074, and a communication unit 3067.

The storage unit 3070 is a storage medium such as a hard disc drive (HDD) and a memory. The storage unit 3070 corresponds to the storage unit 56D in the first embodiment. The acquisition unit 3061, the determination unit 3062, the analysis unit 3063, the switching controller 3064, the reading unit 3071, the receiving unit 3072, the first generating unit 3073, and the second generating unit 3074 corresponds to the acquisition unit 56A, the determination unit 56B, the analysis unit 56C, the switching controller 56E, the reading unit 56K, the receiving unit 56M, the first generating unit 56P, and the second generating unit 56G, respectively.

The communication unit 3067 transmits and receives pieces of data of various types and requests to and from the DFE 3050. To be more specific, the communication unit 3065 receives print data from the DFE 3050. The communication unit 3067 outputs the special color colorant plane data, the On/Off information, and the like to the DFE 3050.

Figure 23:
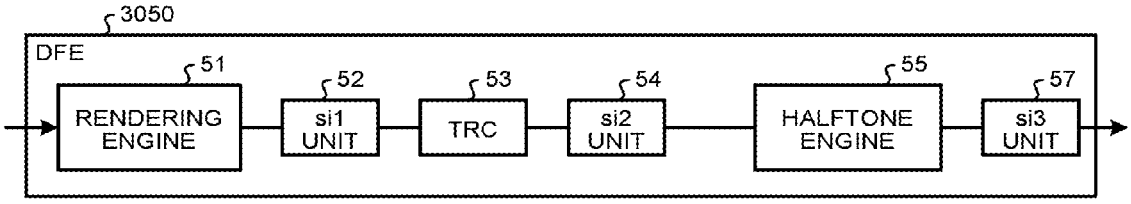
FIG. 23 is a functional block diagram of a DFE.

FIG. 23 is a functional block diagram of the DFE 3050.

The DFE 3050 includes the rendering engine 51, the si1 unit 52, the TRC 53, the si2 unit 54, the halftone engine 55, and the si3 unit 57. The DFE 3050 is the same as the DFE 50 in the first embodiment except for the following points. That is, the DFE 3050 does not include the clear processing 56, transmits the pieces of data that are output to the clear processing 56 to the server device 3060, and receives the pieces of data that are received from the clear processing 56 from the server device 3060.

Figure 24:
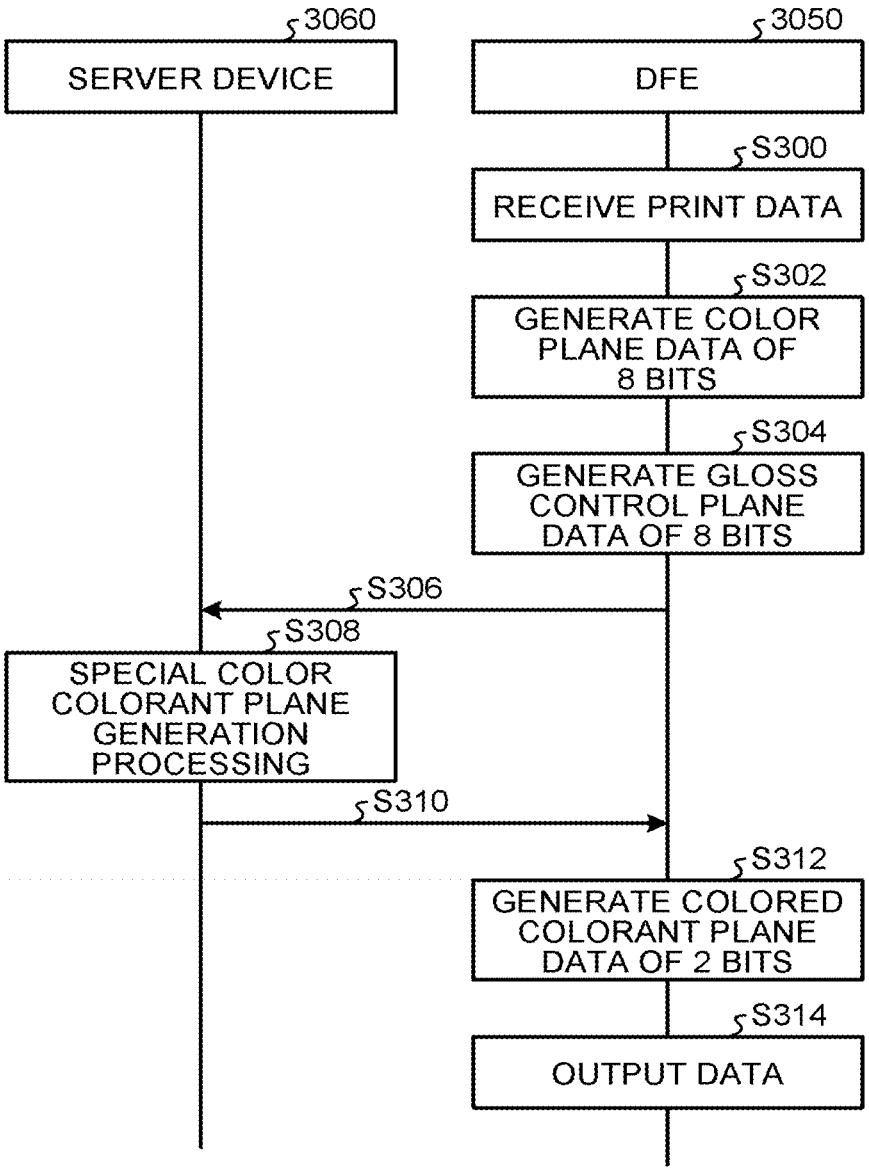
FIG. 24 is a sequence diagram illustrating flow of entire image processing.

Next, image processing by the image processing system in the embodiment configured as described above will be described. FIG. 24 is a sequence diagram illustrating flow of the entire image processing in the embodiment.

First, the DFE 3050 receives the print data (step S300). Then, the DFE 3050 generates the pieces of first color plane data of 8 bits of CMYK (step S302). Then, the DFE 3050 generates the first gloss control plane data of 8 bits (step S304).

Subsequently, the DFE 3050 transmits the print data including the pieces of first color plane data of 8 bits of CMYK, the first gloss control plane data of 8 bits, and the type information to the server device 3060 (step S306).

Then, the server device 3060 executes special color colorant plane generation processing (step S308). The processing at step S308 is the same as the processing described with reference to FIG. 19 in the first embodiment (see step S100 to step S128, FIG. 19).

The server device 3060 outputs the special color colorant plane data to the DFE 3050 (step S310). As in the first embodiment, the server device 3060 outputs the second color plane data, the gloss control value, and the timing information to the DFE 3050 in accordance with a determination result of the determination unit 3062.

The DFE 3050 generates the colored colorant plane data of 2 bits (step S312). Then, the DFE 3050 outputs the output data including the special color colorant plane data received from the server device 3060 and the colored colorant plane data to the printing apparatus 30 through the MIC 60 (step S314). After that, this routine is finished.

The pieces of processing in the MIC 60 and the printing apparatus 30 are performed in the same manner as in the first embodiment.

Thus, in the embodiment, the server device 3060 on a cloud generates the special color colorant plane data. The embodiment therefore provides the same effects as those in the first embodiment. In addition thereto, even when there are a plurality of DFEs 3050, the pieces of output data can be generated collectively, which is convenient for a manager.

Third Embodiment

Although the storage unit 3070, the acquisition unit 3061, the determination unit 3062, the analysis unit 3063, the switching controller 3064, and a second generating unit 3074 are provided on the single server device 3060 on the cloud and the server device 3060 performs processing of generating the special color colorant plane data in the above-mentioned second embodiment, the configuration is not limited thereto.

Figure 25:
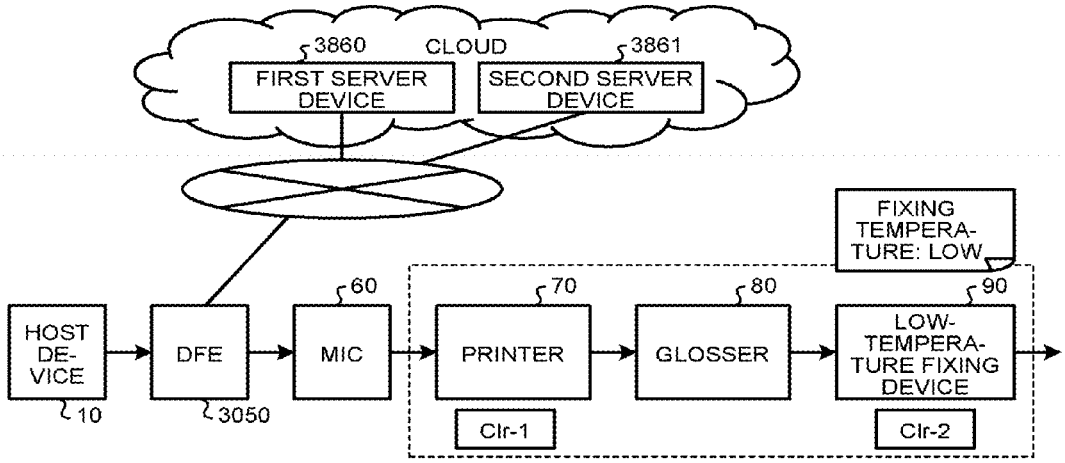
FIG. 25 is a diagram illustrating the network configuration.

For example, equal to or more than two server devices may be provided on the cloud and equal to or more than two server devices may execute the above-mentioned pieces of processing in a dispersed manner. FIG. 25 is a diagram illustrating the network configuration in which two servers (a first server device 3860 and a second server device 3861) are provided on the cloud. In an example of FIG. 25, the first server device 3860 and the second server device 3861 are made to perform the processing of generating the special color colorant plane data in a dispersed manner. The dispersion mode of the respective pieces of processing to the individual server devices is not limited and the dispersion may be performed arbitrarily.

That is to say, any of the plurality of pieces of processing that are performed by one device may be performed by equal to or more than one devices connected to the one device through a network.

In the above-mentioned case where "the pieces of processing are performed by equal to or more than one devices connected to the one device through the network", pieces of processing of inputting and outputting pieces of data (information) between the one device and other devices and between the other devices, such as processing of outputting the pieces of data generated in the pieces of processing performed by the one device to the other devices from the one device and processing of inputting the pieces of data by the other devices, are included.

That is to say, when the other device is one device, the pieces of processing of inputting and outputting the pieces of data between the one device and the other device are included. When the other devices are equal to or more than two devices, the pieces of processing of inputting and outputting the pieces of data between the one device and the other devices and between the other devices, for example, between a first other device and a second other device, are included.

Although the server device 3060 or the plurality of server devices including the first server device 3860 and the second server device 3861 is (are) provided on the cloud in the variations, the invention is not limited thereto. For example, the server device 3060 or the plurality of server devices including the first server device 3860 and the second server device 3861 may be provided on any network such as an intranet.

The hardware configurations of the host device 10, the DFEs 50 and 3050, the server device 3060, the first server device 3860, and the second server device 3861 in the above-mentioned embodiments and variation will be described.

Figure 26:
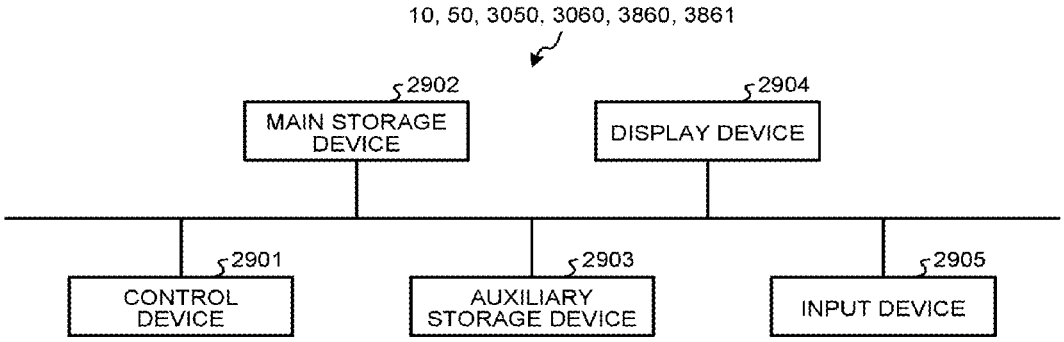
FIG. 26 is a diagram illustrating the hardware configuration.

FIG. 26 is the hardware configuration diagram of the host device 10, the DFEs 50 and 3050, the server device 3060, the first server device 3860, and the second server device 3861. The host device 10, the DFEs 50 and 3050, the server device 3060, the first server device 3860, and the second server device 3861 mainly include, as the hardware configuration, a control device 2901 such as a central processing unit (CPU) controlling the entire device, a main storage device 2902 such as a read only memory (ROM) and a random access memory (RAM) storing therein pieces of data of various types and programs of various types, an auxiliary storage device 2903 such as a hard disc drive (HDD) storing therein pieces of data of various types and programs of various types, an input device 2905 such as a keyboard and a mouse, and a display device 2904 such as a display, and have the hardware configuration using a normal computer.

The pieces of image processing (including the image processing application, the same holds true for the following) that are executed by the host device 10, the DFEs 50 and 3050, the server device 3060, the first server device 3860, and the second server device 3861 in the above-mentioned embodiments and variation are recorded and provided as computer program products in a computer-readable recording medium such as a compact disc read only memory (CD-ROM), a flexible disk (FD), a compact disc recordable (CD-R), and a digital versatile disc (DVD), as an installable or executable file.

The image processing programs that are executed by the host device 10, the DFEs 50 and 3050, the server device 3060, the first server device 3860, and the second server device 3861 in the above-mentioned embodiments and variation may be stored in a computer connected to a network such as the Internet and provided by being downloaded via the network. The image processing programs that are executed by the host device 10, the DFEs 50 and 3050, the server device 3060, the first server device 3860, and the second server device 3861 in the above-mentioned embodiments and variation may be provided or distributed via a network such as the Internet.

The image processing programs that are executed by the host device 10, the DFEs 50 and 3050, the server device 3060, the first server device 3860, and the second server device 3861 in the above-mentioned embodiments and variation may be embedded and provided in the ROM or the like.

Although the image processing system in the above-mentioned embodiments has the configuration including the MIC 60, the printer system is not limited thereto. Another device such as the DFE 50 may perform and have the above-mentioned pieces of processing that are performed by the MIC 60 and functions thereof without providing the MIC 60.

The present invention provides an effect that surface effects other than surface effects of types specified in print data can be checked easily.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image processing apparatus comprising:

a storage unit configured to store therein a surface effect selection table in which density values indicating surface effects as visual or tactile effects on a recording medium, types of the surface effects, and types of linkage effects as other surface effects related to the types of the surface effects are associated with one another;

an acquisition unit configured to acquire print data that includes type information indicating normal printing or test printing, first gloss control plane data specifying density values for specifying the types of the surface effects and gloss regions to which the surface effects are applied, and first color plane data of a color image;

a determination unit configured to determine whether the type information indicates the normal printing or the test printing;

a reading unit configured to read the types of the surface effects and the types of the linkage effects that correspond to the density values specified in the first gloss control plane data from the surface effect selection table when the type information has been determined to indicate the test printing;

a first generating unit configured to generate second gloss control plane data that specifies the types of the surface effects and the gloss regions that are specified in the first gloss control plane data, and the types of the linkage effects corresponding to the types of the surface effects having been read and linkage regions to which the linkage effects are applied; and a second generating unit configured to generate special color colorant plane data that is used by an execution unit configured to apply a special color colorant onto the recording medium from the first gloss control plane data and the second gloss control plane data.

2. The image processing apparatus according to claim 1, further comprising:

a calculation unit configured to calculate pieces of analysis information of the surface effects in the first gloss control plane data when the type information has been determined to indicate the normal printing;

a first updating unit configured to update history information in which the types of the surface effects and the pieces of analysis information are associated with each other in accordance with a calculation result by the calculation unit; and a second updating unit configured to update the surface effect selection table by selecting other types of surface effects to be linked to the respective types of the surface effects in accordance with the history information and registering the selected other types of the surface effects as the types of the linkage effects corresponding to the respective types of the surface effects.

3. The image processing apparatus according to claim 2, wherein the second updating unit updates the surface effect selection table by selecting other types of the surface effects that are at least one of similar and non-similar to the respective types of the surface effects in accordance with the history information and registering the selected other types of the surface effects as the types of the linkage effects corresponding to the respective types of the surface effects.

4. The image processing apparatus according to claim 3, wherein the second updating unit updates the surface effect selection table by selecting other types of the surface effects that are at least one of similar and non-similar to the respective types of the surface effects and are set by a user in accordance with the history information and registering the selected other types of the surface effects as the types of the linkage effects corresponding to the respective types of the surface effects.

5. The image processing apparatus according to claim 2, wherein the second updating unit updates the surface effect selection table by selecting other types of the surface effects to be linked to the respective types of the surface effects in accordance with the history information in a range or a period designated by a user and registering the selected other types of the surface effects as the types of the linkage effects corresponding to the respective types of the surface effects.

6. The image processing apparatus according to claim 2, wherein the second updating unit updates the surface effect selection table by receiving at least one of change of at least a part of the types of the linkage effects registered in the surface effect selection table and registration of a new type of a linkage effect by an operation instruction with an input unit by a user and registering the received type of the linkage effect in the surface effect selection table.

7. The image processing apparatus according to claim 2, wherein the pieces of analysis information include numbers of times of usage of the types of the surface effects and average areas of the gloss regions per usage.

8. The image processing apparatus according to claim 6, wherein the pieces of analysis information include numbers of times of usage of the types of the surface effects and average areas of the gloss regions per usage.

9. The image processing apparatus according to claim 1, further comprising a receiving unit configured to receive designation of setting information indicating print setting of each of the gloss regions and the linkage regions on the recording medium, wherein the first generating unit generates the second gloss control plane data in accordance with the received setting information.

10. The image processing apparatus according to claim 9, wherein the receiving unit receives designation of the setting information set by a user.

11. The image processing apparatus according to claim 9, wherein the first generating unit generates the second gloss control plane data specifying, on different pages, the types of the surface effects and the gloss regions specified in the first gloss control plane data and the types of the linkage regions corresponding to the types of the surface effects having been read and the linkage regions to which the linkage effects are applied.

12. The image processing apparatus according to claim 9, wherein the execution unit forms the color image on the recording medium based on colored colorant plane data for causing a colored colorant to adhere, when the received setting information represents first setting indicating extraction of an overlapped region, the first generating unit further generates second color plane data formed by extracting the overlapped region in the color image specified in the first color plane data that overlaps with the gloss regions indicated by the first gloss control plane data, and the second generating unit further generates the colored colorant plane data that is used by the execution unit from the second color plane data.

13. The image processing apparatus according to claim 9, wherein when second setting indicating printing speed that is represented by the received setting information indicates both of image quality priority and speed priority, the first generating unit generates the second gloss control plane data including:

third gloss control plane data as the image quality priority that specifies the types of the surface effects and the gloss regions specified in the first gloss control plane data and the types of the linkage effects corresponding to the types of the surface effects having been read and the linkage regions; and fourth gloss control plane data as the speed priority which specifies the types of the surface effects and the gloss regions specified in the first gloss control plane data and the types of the linkage effects corresponding to the types of the surface effects having been read and the linkage regions, and in which the density values are adjusted such that a total amount of colorants to be applied to pixels is equal to or smaller than a total amount restriction value.

14. The image processing apparatus according to claim 9, wherein when the received setting information represents third setting indicating that the gloss regions and the linkage regions are printed on a set number of recording pages, the first generating unit generates the second gloss control plane data in which the gloss regions specified in respective pages included in the first gloss control plane data and the linkage regions are arranged on the set number of pages.

15. The image processing apparatus according to claim 14, wherein when the received setting information represents the third setting and fourth setting indicating that the gloss regions of the types of the surface effects specified in the first gloss control plane data and the linkage regions of the linkage effects corresponding to the types of the surface effects are rearranged within the set number of pages, the first generating unit generates the second gloss control plane data in which the gloss regions specified in respective pages included in the first gloss control plane data and the linkage regions corresponding to the gloss regions having been read are rearranged within the set number of pages.

16. The image processing apparatus according to claim 14, wherein when the received setting information represents the third setting and fifth setting indicating that the gloss regions of the types of the surface effects specified in the first gloss control plane data formed by a plurality of pages and the linkage regions of the linkage effects corresponding to the types of the surface effects are aggregated in the set number of pages, the first generating unit generates the second gloss control plane data in which the gloss regions specified in the respective pages included in the first gloss control plane data and the linkage regions corresponding to the gloss regions having been read are aggregated and arranged in the set number of pages while maintaining relative positions of the gloss regions in respective pages of the second gloss control plane data.

17. The image processing apparatus according to claim 1, wherein the execution unit forms the color image on the recording medium based on colored colorant plane data for causing a colored colorant to adhere, and the first generating unit generates second color plane data by adding the color image expressing each of character information indicating the types of the surface effects of the corresponding gloss regions and character information indicating the types of the linkage effects of the corresponding linkage regions at positions corresponding to the gloss regions and the linkage regions, respectively, in the second gloss control plane data.

18. An image processing method executed by an image processing apparatus that comprises a storage unit configured to store therein a surface effect selection table in which density values indicating surface effects as visual or tactile effects on a recording medium, types of the surface effects, and types of linkage effects as other surface effects related to the types of the surface effects are associated with one another, the image processing method comprising:

acquiring print data that includes type information indicating normal printing or test printing, first gloss control plane data specifying density values for specifying the types of the surface effects and gloss regions to which the surface effects are applied, and first color plane data of a color image;

determining whether the type information indicates the normal printing or the test printing;

reading the types of the surface effects and the types of the linkage effects that correspond to the density values specified in the first gloss control plane data from the surface effect selection table when the type information has been determined to indicate the test printing;

generating second gloss control plane data that specifies the types of the surface effects and the gloss regions that are specified in the first gloss control plane data, and the types of the linkage effects corresponding to the types of the surface effects having been read and linkage regions to which the linkage effects are applied; and generating special color colorant plane data that is used by an execution unit configured to apply a special color colorant onto the recording medium from the first gloss control plane data and the second gloss control plane data.

19. An image processing system comprising:

an execution unit configured to apply a special color colorant to a recording medium in accordance with special color colorant plane data;

a storage unit configured to store therein a surface effect selection table in which density values indicating surface effects as visual or tactile effects on a recording medium, types of the surface effects, and types of linkage effects as other surface effects related to the types of the surface effects are associated with one another;

an acquisition unit configured to acquire print data that includes type information indicating normal printing or test printing, first gloss control plane data specifying density values for specifying the types of the surface effects and gloss regions to which the surface effects are applied, and first color plane data of a color image;

a determination unit configured to determine whether the type information indicates the normal printing or the test printing;

a reading unit configured to read the types of the surface effects and the types of the linkage effects that correspond to the density values specified in the first gloss control plane data from the surface effect selection table when the type information has been determined to indicate the test printing;

a first generating unit configured to generate second gloss control plane data that specifies the types of the surface effects and the gloss regions that are specified in the first gloss control plane data, and the types of the linkage effects corresponding to the types of the surface effects having been read and linkage regions to which the linkage effects are applied; and a second generating unit configured to generate the special color colorant plane data from the first gloss control plane data and the second gloss control plane data.

20. The image processing system according to claim 19, comprising:

an image processing apparatus including the execution unit, the acquisition unit, the reading unit, the first generating unit, and the second generating unit, and the storage unit provided as a separated body from the image processing apparatus.

* * * * *